US005918527A

United States Patent [19]

Haga et al.

[11] Patent Number: 5,918,527

[45] Date of Patent: Jul. 6, 1999

[54] LOCUS CONTROL SYSTEM FOR CONSTRUCTION MACHINES

[75] Inventors: Masakazu Haga, Ibaraki-ken; Hiroshi Watanabe, Ushiku; Kazuo Fujishima, Ibaraki-ken, all of Japan

[73] Assignee: Hitachi Construction Machinery Co., Ltd., Tokyo, Japan

[21] Appl. No.: 08/842,042

[22] Filed: Apr. 23, 1997

[30] Foreign Application Priority Data

Apr. 26, 1996 [JP] Japan ..... 8-107212

[51] Int. Cl.[6] ..... F15B 9/03

[52] U.S. Cl. ..... 91/363 R; 172/4.5; 414/699

[58] Field of Search ..... 91/361, 363 R; 37/348; 172/2, 4.5; 414/699

[56] References Cited

U.S. PATENT DOCUMENTS

| | | | |
|---|---|---|---|
| 4,332,517 | 6/1982 | Igarashi et al. | 414/699 |
| 4,889,466 | 12/1989 | Jindai et al. | 414/699 |
| 4,910,673 | 3/1990 | Narisawa et al. | 172/2 |
| 5,160,239 | 11/1992 | Allen et al. | 414/699 |
| 5,308,219 | 5/1994 | Lee et al. | 414/699 |
| 5,701,691 | 12/1997 | Watanabe et al. | 37/348 |
| 5,735,065 | 4/1998 | Yamagata et al. | 37/348 |

FOREIGN PATENT DOCUMENTS

| | | |
|---|---|---|
| 0707118A1 | 4/1996 | European Pat. Off. . |
| 0711876A1 | 5/1996 | European Pat. Off. . |
| 0747541A1 | 12/1996 | European Pat. Off. . |
| 59-195937 | 11/1984 | Japan . |
| 59-195938 | 11/1984 | Japan . |
| 59-195939 | 11/1984 | Japan . |
| 60-030728 | 2/1985 | Japan . |
| 60-033940 | 2/1985 | Japan . |
| 60-095035 | 5/1985 | Japan . |
| 61-200226 | 9/1986 | Japan . |
| 61-266740 | 11/1986 | Japan . |
| 06193090 | 7/1994 | Japan . |
| 06336747 | 12/1994 | Japan . |
| WO95/30059 | 9/1995 | WIPO . |
| WO97/07296 | 2/1997 | WIPO . |
| WO97/07297 | 2/1997 | WIPO . |

*Primary Examiner*—F. Daniel Lopez
*Attorney, Agent, or Firm*—Fay, Sharpe, Beall, Fagan, Minnich & McKee

[57] ABSTRACT

A locus control system of hydraulic excavators whereby a target locus for a front device is set beforehand. A control unit calculates a position and posture of the front device based on signals from angle sensors, and calculates a target speed vector of the front device based on signals from control lever devices. Through this calculation process, the control unit maintains the target speed vector as it is when the front device is not near the target locus, and modifies the target speed vector to a vector pointing to a second point on the target locus advanced in the excavating direction by a second distance from a first point located on the target locus at a minimum distance from a tip of the front device, when the front device is near the target locus.

19 Claims, 19 Drawing Sheets

9
9a
TARGET LOCUS SETTING CALCULATION
9b
FRONT POSTURE CALCULATION
9c
TARGET CYLINDER SPEED CALCULATION
9d
TARGET TIP SPEED VECTOR CALCULATION
9e
VECTOR DIRECTION MODIFICATION
9f
POST -MODIFICATION TARGET CYLINDER SPEED CALCULATION
9g
TARGET PILOT PRESSURE CALCULA-TION
9h
VALVE COMMAND CALCULA-TION
60a
60b
61a
61b
8a
8b
8c
8d
7
10a
10b
11a
11b

LOCUS CONTROL SYSTEM FOR CONSTRUCTION MACHINES

BACKGROUND OF THE INVENTION

The present invention relates to a control system for construction machines such as hydraulic excavators, and more particularly to a locus control system for construction machines which enables a bucket tip, for example, to be moved along a target locus.

A prior art control system for construction machines is proposed in, e.g., International Patent Laid-Open WO 95/30059.

According to the above prior art, in an area limiting control system for hydraulic excavators, an area in which a front device is allowed to move is set beforehand, and a control unit calculates a position and posture of the front device based on signals from angle sensors and also calculates a target speed vector of the front device based on signals from control lever devices. Through the calculation, the control unit maintains the target speed vector as it is when the front device is within the set area away from its boundary, modifies the target speed vector to reduce a vector component in the direction approaching the boundary of the set area when the front device is within the set area near its boundary, and modifies the target speed vector to return the front device to the set area when the front device is outside the set area. In this way, the conventional control system intends to perform excavation in a limited area efficiently and smoothly.

SUMMARY OF THE INVENTION

In general, when an operator is going to move a tip of a front device along a certain target locus in an actual work site, the operator usually moves the tip of the front device while unconsciously thinking which path should be taken to reach the target locus. For example, when an operating speed of the tip of the front device is relatively slow, the operator selects a path through which the tip of the front device reaches the target locus over the shortest distance, and a target speed vector is set corresponding to the selected path with top priority given to the quickest way to reach the target locus. When an operating speed of the tip of the front device is relatively fast, the operator selects a path through which the tip of the front device moves to reach the target locus on the side slightly forward of a target point in the excavating direction, rather than over the shortest distance, and a target speed vector is set corresponding to the selected path with top priority given to soft landing to the target locus. In locus or area limiting control, therefore, it is desired to perform the control in a like manner to the process actually effected by the operator so that the tip of the front device moves in match with a human feeling to the extent possible A control process of the above control system of the prior art will now be described in more detail. Supposing that as shown in FIG. 19, for example, when the operator operates a control lever to instruct a certain speed command vector A with the intention of moving a tip of a front device 1A (comprising a boom 1*a*, an arm 1*b* and a bucket 1*c*) rotatably coupled to a body 1B, i.e., a tip of the bucket 1*c*, vertical to a target locus, a component of the speed command vector A vertical to the target locus is given by Ay. But since Ay is too large with respect to a distance y between the tip of the bucket 1*c* and the target locus, a Y-component vector By for moving the boom 1*a* upward is calculated to slow down the tip of the bucket 1*c*. The Y-component vector By is calculated, by way of example, as follows. A certain table for correlating Ay with the distance y between the tip of the bucket 1*c* and the target locus is prepared beforehand. The table is set such that By for reducing Ay is equal to 0 (By=0) and Ay is not modified for slowdown when y is greater than a predetermined distance yo. Then, when y is smaller than the predetermined distance yo, By for reducing Ay takes a larger value at a smaller value of y.

Subsequently, based on By calculated in that way, a speed command vector B in the direction of actual movement of the boom 1*a* is calculated and, thereafter, the boom 1*a* is moved. As a result, the target speed vector at the tip of the bucket 1*c* is provided by A+B as shown.

In the above control process, an emphasis is placed on just preventing the tip of the bucket 1*c* to the utmost from moving down beyond the target locus. In other words, the direction of a final target speed vector at the tip of the bucket 1*c* is merely determined as a result of calculation executed after the operator operates the control lever. Accordingly, which path the tip of the bucket 1*c* takes to settle to the target locus is varied depending on the operation made by the operator. Thus, there is a difficulty in stability of control, resulting in that the tip of the bucket 1*c* may move past the target locus several times or may cause a hunting for the target locus.

An object of the present invention is to provide a locus control system for construction machines which enables a tip of a front device to settle to a target locus through a satisfactory path always in match with a human feeling, and hence which ensures stable and accurate operation.

(1) To achieve the above object, according to the present invention, in a locus control system equipped on a construction machine comprising a plurality of members to be driven including a plurality of front members which constitute a multi-articulated front device and are each rotatable vertically, a plurality of hydraulic actuators for driving respectively the plurality of driven members, a plurality of operating means for instructing movements of the plurality of members to be driven, and a plurality of hydraulic control valves driven in accordance with operation signals from the plurality of operating means and controlling flow rates of a hydraulic fluid supplied to the plurality of hydraulic actuators, the locus control system comprising locus setting means for setting a target locus along which the front device is to be moved, first detecting means for detecting status variables in relation to a position and posture of the front device, first calculating means for calculating the position and posture of the front device based on signals from the first detecting means, and signal modifying means for, based on the operation signals from those ones of the plurality of operating means associated with particular front members and values calculated by the first calculating means, modifying at least one of the operation signals from those operating means associated with the particular front members so that the front device is moved to reach the target locus, the signal modifying means modifies the operation signals so that the front device is moved toward a second point on the target locus advanced in the excavating direction by a second distance from a first point locating on the target locus at a first distance from the front device.

Specifically, when the front device approaches and reaches the vicinity of the target locus which has been set by the locus setting means beforehand and along which the front device is to be moved, the signal modifying means modifies, based on the operation signals from the operating means associated with particular front members and values in relation to the position and posture of the front device calculated by the first calculating means, the operation signals from the operating means associated with the particular front members so that the front device is moved to finally reach the target locus.

In the present invention, when the front device is moved to finally reach the target locus through the above process, the signal modifying means modifies the operation signals so that the front device is moved toward the second point, i.e., a point on the target locus advanced in the excavating direction by the second distance from the first point locating on the target locus at the first distance from the front device. With this modification, the direction of movement of the front device, i.e., the direction of a target vector, is always controlled to point to the second point regardless of how an operator operates the operating means.

Then, in determining the second point, a path of movement of the front device from the current position to the target locus can be set to any desired path optionally depending on applications and/or situations of work by, e.g., selecting the second distance to be small so that the front device is more quickly moved from the current position to the target locus, or selecting the second distance to be large so that the front device approaches the target locus more moderately. Accordingly, unlike the conventional system wherein which path the tip of the front device follows until reaching the target locus is not definite but depends on the operation of the operator, the tip of the front device can be settled to the target locus in a relatively quick, stable and highly accurate manner through a satisfactory path in match with a human feeling.

(2) In the locus control system for a construction machine of above (1), preferably, the signal modifying means modifies the operation signals so that the front device is moved toward a second point on the target locus advanced in the excavating direction by a second distance from a first point located on the target locus at a first distance from an excavating part of the front device.

(3) In the locus control system for a construction machine of above (1), preferably, the signal modifying means use, as the first distance, a minimum distance between the target locus and the front device.

(4) In the locus control system for a construction machine of above (1), preferably, the signal modifying means sets the second distance as a fixed value.

(5) In the locus control system for a construction machine of above (1), preferably, the signal modifying means sets the second distance to be variable depending on the first distance.

With this feature, for example, by setting the second distance to be small when the first distance is relatively large, the tip of the front device can be quickly settled to the target locus.

(6) In the locus control system for a construction machine of above (1), preferably, the signal modifying means sets the second distance to be variable depending on the operation signals from the operating means for the front device.

With this feature, for example, by setting the second distance to be large when the magnitudes of the operation signals instructing the front device to move is relatively large, a hunting or the like can be prevented and stability in the control process can be increased.

(7) In the locus control system for a construction machine of above (1), preferably, the signal modifying means sets the second distance to be variable depending on a moving speed of the front device.

With this feature, for example, by setting the second distance to be large when the moving speed of the tip of the front device is relatively fast, a hunting or the like can be prevented and stability in the control process can be increased.

(8) In the locus control system for a construction machine of above (1), preferably, the signal modifying means includes second calculating means for calculating a target speed vector of the front device based on the operation signals from the operating means associated with the particular front members, third calculating means for receiving values calculated by the first and second calculating means, calculating a modification vector to modify the target speed vector based on the received values, and modifying the target speed vector based on the modification vector to point to the second point, and valve control means for driving the associated hydraulic control valves so that the front device is moved in accordance with the target speed vector modified by the third calculating means.

(9) In the above locus control system for a construction machine of (1), preferably, the signal modifying means modifies the operation signals only when the first distance is not greater than a predetermined distance.

With this feature, when the front device is away from the target locus in excess of the predetermined distance, work can be performed by operating the front device in the same manner as usual.

(10) In the locus control system for a construction machine of above (8), more preferably, the third calculating means includes modification vector altering means for altering the modification vector depending on the first distance.

(11) More preferably, in the locus control system for a construction machine of above (7) wherein at least those ones of the plurality of operating means associated with the particular front members are of a hydraulic pilot type outputting pilot pressures as the operation signals, and an operating system including the operating means of hydraulic pilot type drives the associated hydraulic control valves, the control system further comprises second detecting means for detecting input amounts by which the operating means of a hydraulic pilot type are operated, the second calculating means is means for calculating a target speed vector of the front device based on signals from the second detecting means, and the valve control means includes fourth calculating means for, based on the modified target speed vector, calculating target pilot pressures for driving the associated hydraulic control valves, and pilot control means for controlling the operating system so that the target pilot pressures are established

(12) In the locus control system for a construction machine of above (11), more preferably, the operating system includes a first pilot line for introducing a pilot pressure to the associated hydraulic control valve so that the front device is moved away from the target locus, the fourth calculating means includes means for calculating a target pilot pressure in the first pilot line based on the modified target speed vector, and the pilot control means includes means for outputting a first electric signal corresponding to the target pilot pressure, electro-hydraulic converting means for converting the first electric signal into a hydraulic pressure and outputting a control pressure corresponding to the target pilot pressure, and the higher pressure selecting means for selecting higher one of the pilot pressure in the first pilot line and the control pressure output from the electro-hydraulic converting means, and introducing the selected pressure to the associated hydraulic control valve.

(13) In the locus control system for a construction machine of above (11), more preferably, the operating system includes a second pilot line for introducing a pilot pressure to the associated hydraulic control valve so that the front device is moved toward the target locus, the fourth calculating means includes means for calculating a target pilot pressure in the second pilot line based on the modified target speed vector, and the pilot control means includes means for outputting a second electric signal corresponding to the target pilot pressure and pressure reducing means disposed in the second pilot line and operated in accordance with the second electric signal for reducing the pilot pressure in the second pilot lines to the target pilot pressure

(14) In the locus control system for a construction machine of above (11), more preferably, the operating system includes a first pilot line for introducing a pilot pressure to the associated hydraulic control valve so that the front device is moved away from the target locus, and a second pilot line for introducing a pilot pressure to the associated hydraulic control valve so that the front device is moved toward the target locus, the fourth calculating means includes means for calculating target pilot pressures in the first and second pilot lines based on the modified target speed vector, and the pilot control means includes means for outputting first and second electric signals corresponding to the target pilot pressures, electro-hydraulic converting means for converting the first electric signal into a hydraulic pressure and outputting a control pressure corresponding to the target pilot pressure, higher pressure selecting means for selecting the higher one of the pilot pressure in the first pilot line and the control pressure output from the electro-hydraulic converting means and introducing the selected pressure to the associated hydraulic control valve, and pressure reducing means disposed in the second pilot line and operated in accordance with the second electric signal for reducing the pilot pressure in the second pilot line to the target pilot pressure.

(15) In the locus control system for a construction machine of above (12) or (14), more preferably, the particular front members include a boom and an arm of a hydraulic excavator, and the first pilot line is a pilot line on the boom-up side.

(16) In the locus control system for a construction machine of above (13) or (14), more preferably, the particular front members include a boom and an arm of a hydraulic excavator, and the second pilot line comprises pilot lines on the boom-down side and the arm crowding side.

(17) In the locus control system for a construction machine of above (13) or (14), more preferably, the particular front members include a boom and an arm of a hydraulic excavator, and the second pilot line comprises pilot lines on the boom-down side, the arm crowding side, and the arm dumping side.

(18) In the locus control system for a construction machine of above (1), preferably, the first detecting means includes a plurality of angle sensors for detecting rotational angles of the plurality of front members.

(19) In the locus control system for a construction machine of above (1), preferably, the first detecting means includes a plurality of displacement sensors for detecting strokes of the plurality of actuators.

(20) In the locus control system for a construction machine of above (11), more preferably, the second detecting means comprises pressure sensors disposed in the pilot lines of the operating system

(21) In the locus control system for a construction machine of any of above (1) to (20), the signal modifying means modifies the operation signals only when the operation signals from those ones of the plurality of operating means associated with the particular front members are operation signals in the direction causing the front device to approach the target locus.

With this feature, the control process can be further simplified and the tip of the front device can be more smoothly moved away from the target locus when it should depart from the vicinity of the target locus.

DETAILED DESCRIPTION OF THE PREFERRED EMBODIMENT

One embodiment in which the present invention is applied to a hydraulic excavator will be described hereunder with reference to FIGS. 1 to 15.

Figure 1:
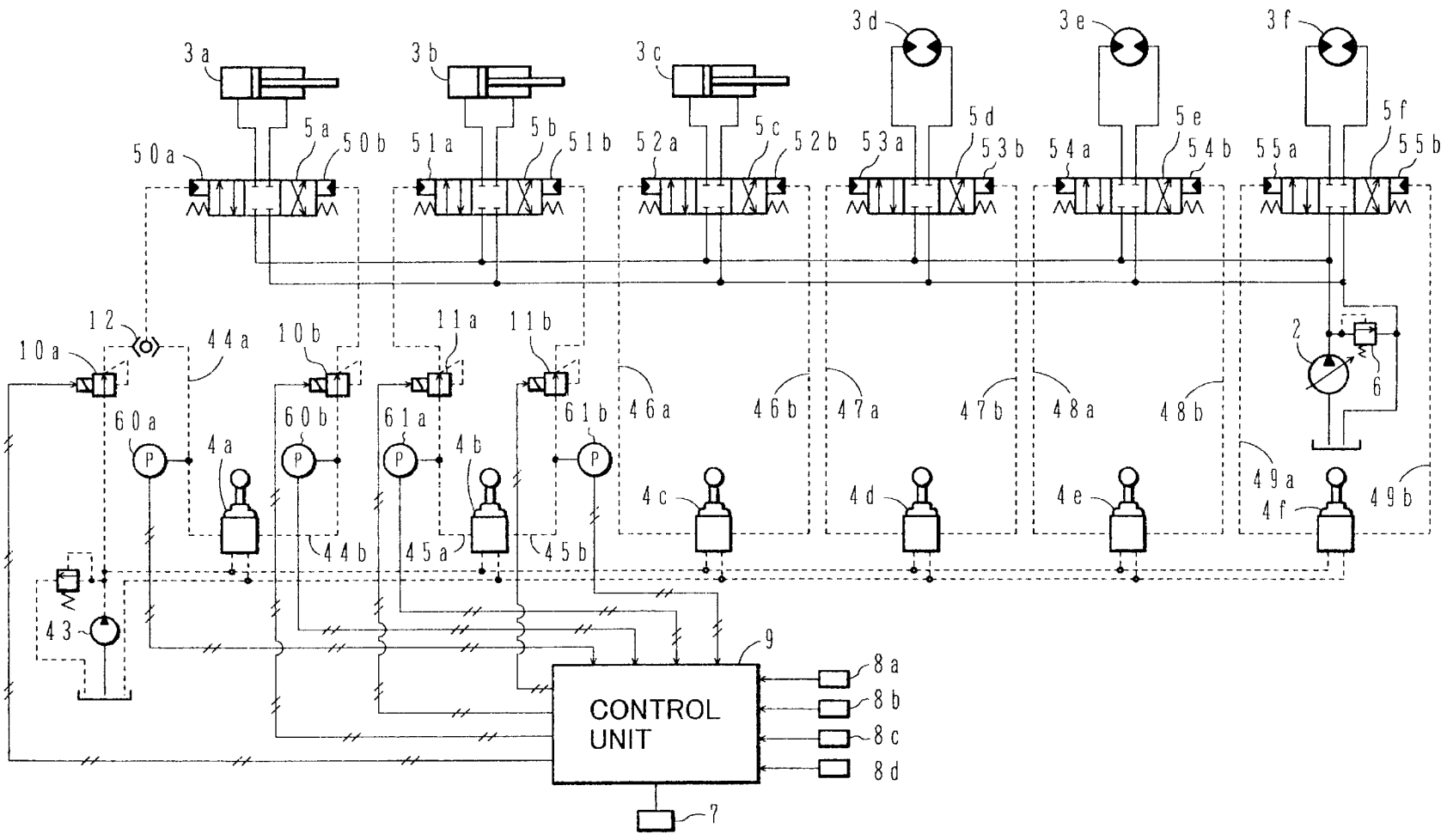
FIG. 1 is a diagram showing a locus control system for construction machines according to one embodiment of the present invention, along with a hydraulic drive system thereof.

In FIG. 1, a hydraulic excavator to which the present invention is applied has a hydraulic pump 2, a plurality of hydraulic actuators including a boom cylinder 3*a*, an arm cylinder 3*b*, a bucket cylinder 3*c*, a swing motor 3*d*, and left and right track motors 3*e*, 3*f* which are driven by a hydraulic fluid supplied from the hydraulic pump 2, a plurality of control lever devices 4*a*–4*f* provided respectively corresponding to the hydraulic actuators 3*a*–3*f*, a plurality of flow control valves 5*a*–5*f* connected between the hydraulic pump 2 and the plurality of hydraulic actuators 3*a*–3*f* and controlled in accordance with operation signals from the control lever devices 4*a*–4*f* to serve as hydraulic control valves for controlling flow rates of the hydraulic fluid supplied to the hydraulic actuators 3*a*–3*f*, respectively, and a relief valve 6 made open when a pressure between the hydraulic pump 2 and any of the flow control valves 5*a*–5*f* exceeds a set value. These components make up a hydraulic drive system for driving members to be driven of the hydraulic excavator.

Figure 2:
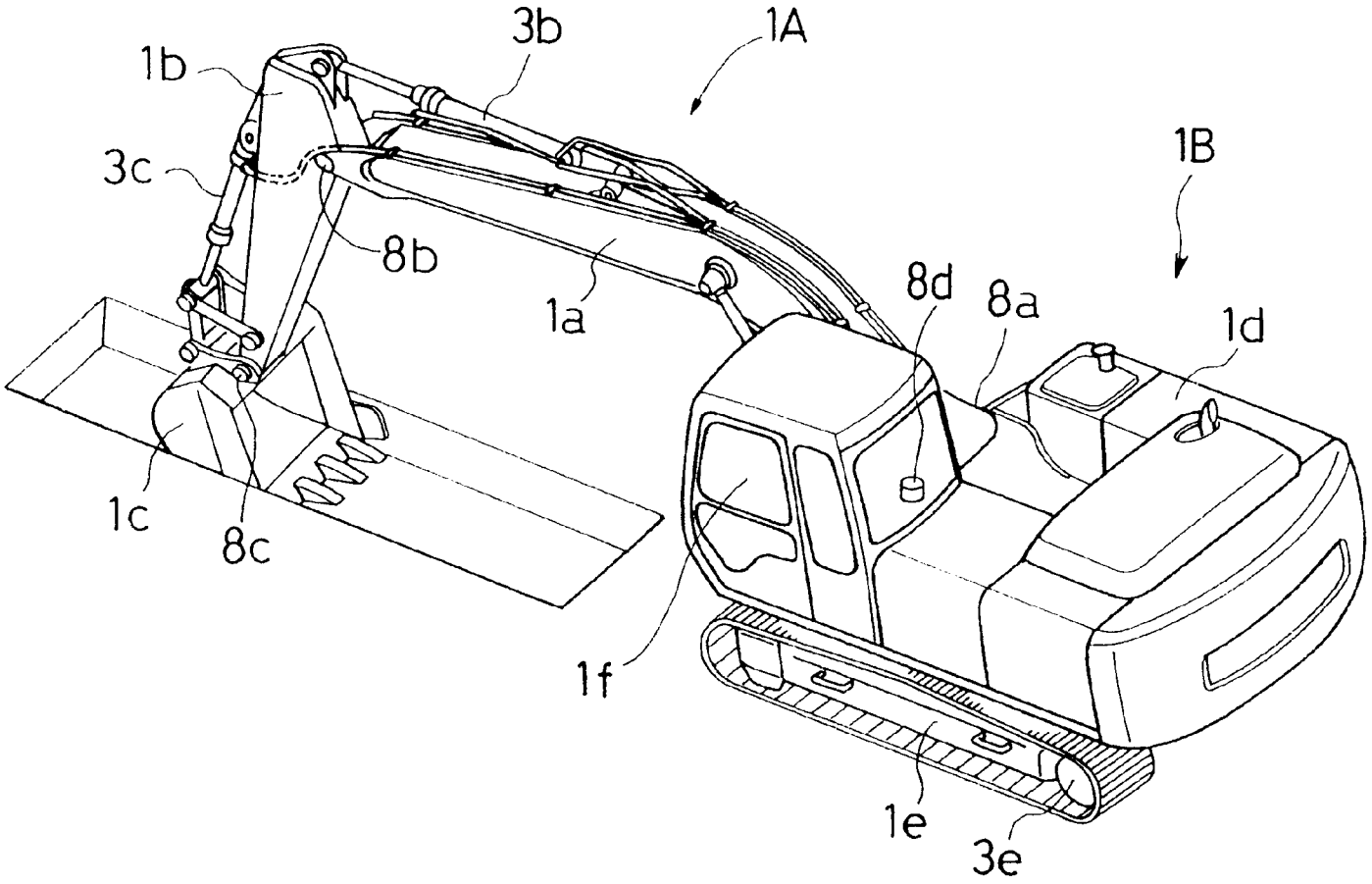
FIG. 2 is an perspective view showing an appearance of a hydraulic excavator to which the present invention is applied.

Also, the hydraulic excavator comprises, as shown in FIG. 2, a multi-articulated front device 1A made up of a boom 1*a*, an arm 1*b* and a bucket 1*c* which are each rotatable in the vertical direction, and a body 1B consisted of an upper swing structure 1*d* and an under travelling carriage 1*e*. The boom 1*a* of the front device 1A is supported at its based end by a front portion of the upper swing structure 1*d*. The boom 1*a*, the arm 1*b*, the bucket 1*c*, the upper swing structure 1*d* and the under travelling carriage 1*e* serve as members to be driven which are driven respectively by the boom cylinder 3*a*, the arm cylinder 3*b*, the bucket cylinder 3*c*, the swing motor 3*d*, and the left and right track motors 3*e*, 3*f*. Movements of the driven members are instructed from the control levers unit 4*a*–4*f*.

Figure 3:
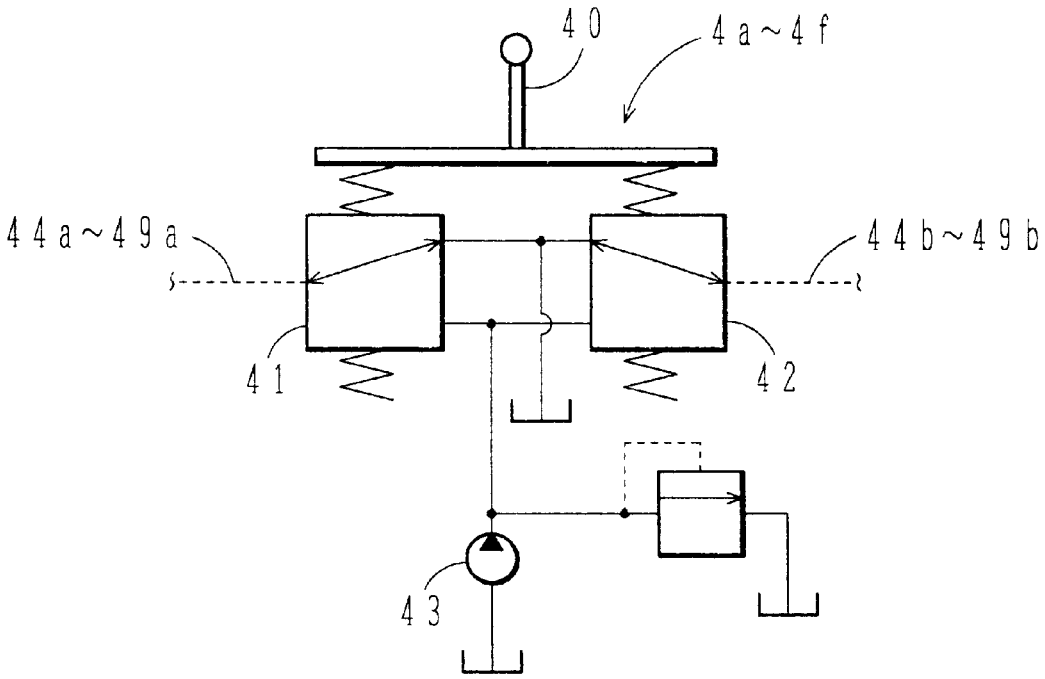
FIG. 3 is a diagram showing details of a control lever device of hydraulic pilot type.
Figure 4:
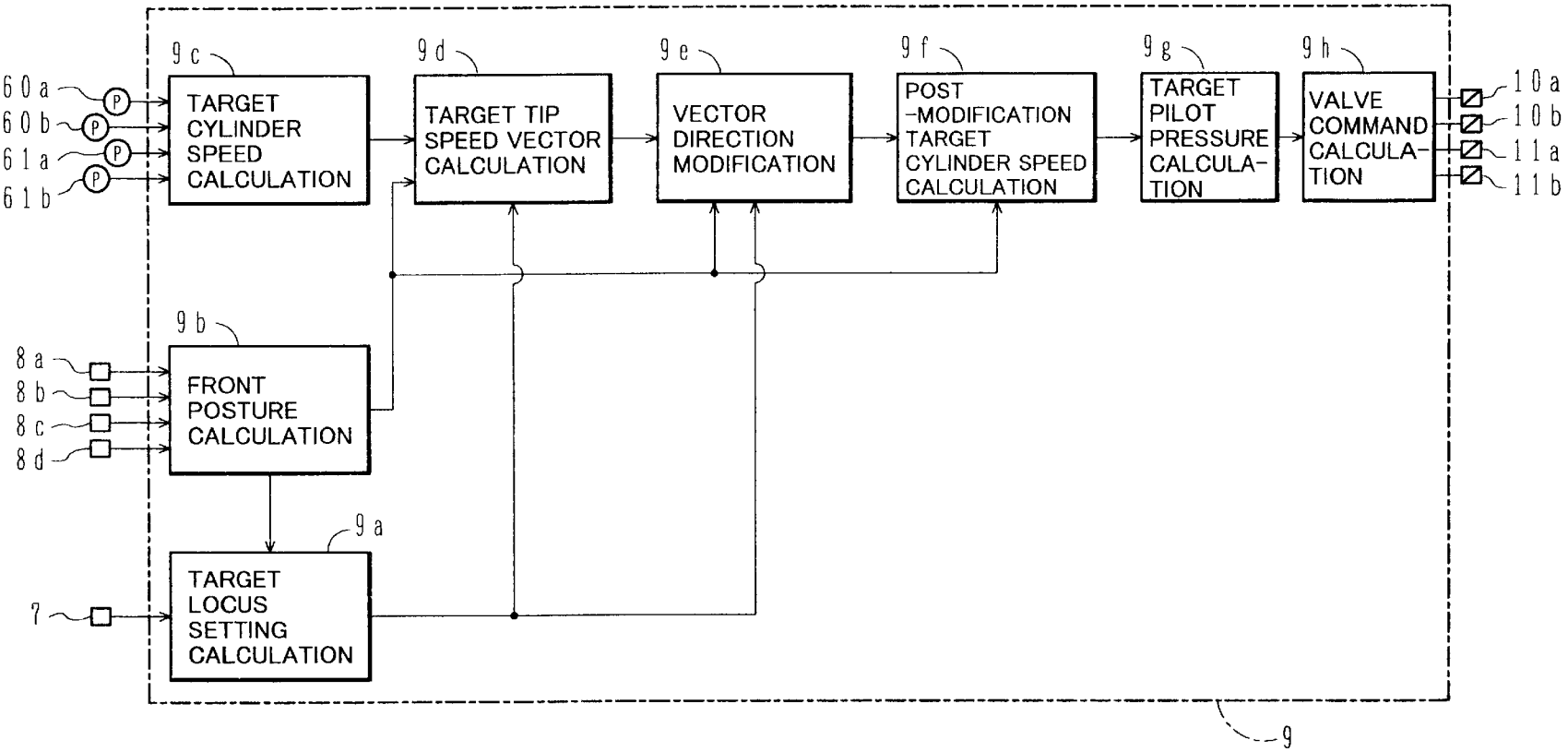
FIG. 4 is a functional block diagram showing control functions of a control unit.

The control lever devices 4*a*–4*f* in FIG. 1 are each of a hydraulic pilot type driving a corresponding one of the flow control valves 5*a*–5*f* with a pilot pressure. Each of the control lever devices 4*a*–4*f* comprises, as shown in FIG. 3, a control lever 40 operated by the operator, and a pair of pressure reducing valves 41, 42 for generating a pilot pressure depending on the input amount and the direction by and in which the control lever 40 is operated. The pressure reducing valves 41, 42 are connected at primary ports to a pilot pump 43, and at secondary ports to corresponding ones of hydraulic driving sectors 50*a*, 50*b*; 51*a*, 51*b*; 52*a*, 52*b*; 53*a*, 53*b*; 54*a*, 54*b*; 55*a*, 55*b* of the flow control valves through pilot lines 44*a*, 44*b*; 45*a*, 45*b*; 46*a*, 46*b*; 47*a*, 47*b*; 48*a*, 48*b*; 49*a*, 49*b*.

A locus control system according to this embodiment is equipped on the hydraulic excavator constructed as explained above. The control system comprises a setting device 7 for providing an instruction to set a target locus along which a predetermined part of the front device, e.g., a tip of the bucket 1*c*, is to be moved, depending on the scheduled work beforehand, angle sensors 8*a*, 8*b*, 8*c* disposed respectively at pivot points of the boom 1*a*, the arm 1*b* and the bucket 1*c* for detecting respective rotational angles α, β, γ thereof (see FIG. 5 described later) as status variables in relation to a position and posture of the front device 1A, a tilt angle sensor 8*d* for detecting a tilt angle θ of the body 1B in the back-and-forth direction, pressure sensors 60*a*, 60*b*; 61*a*, 61*b* disposed in the pilot lines 44*a*, 44*b*; 45*a*, 45*b* connected to the boom and arm control lever devices 4*a*, 4*b* for detecting respective pilot pressures as the input amounts by which the control lever devices 4*a*, 4*b* are operated, a control unit 9 for receiving a setup signal of the setting device 7, detection signals of the angle sensors 8*a*, 8*b*, 8*c* and the tilt angle sensor 8*d* and detection signals of the pressure sensors 60*a*, 60*b*; 61*a*, 61*b*, setting the target locus along which the tip of the bucket 1*c* is to be moved, and outputting electric signals to perform control for excavation along the target locus, proportional solenoid valves 10*a*, 10*b*, 11*a*, 11*b* driven by the electric signals output from the control unit 9, and a shuttle valve 12.

The proportional solenoid valve 10*a* has a primary port connected to the pilot pump 43 and a secondary port connected to the shuttle valve 12. The shuttle valve 12 is disposed in the pilot line 44*a* to select the higher one of the pilot pressure in the pilot line 44*a* and the control pressure reduced by the proportional solenoid valve 10*a*, and then introduce the selected pressure to the hydraulic driving sector 50*a* of the flow control valve 5*a*. The proportional solenoid valves 10*b*, 11*a*, 11*b* are disposed in the pilot lines 44*b*, 45*a*, 45*b*, respectively, to reduce the pilot pressures in the pilot lines in accordance with the respective electric signals applied thereto and output the reduced pilot pressures.

The setting device 7 comprises operating means, such as a switch, disposed on a control panel or grip for outputting a setup signal to the control unit 9 to instruct setting of the target locus. Other suitable aid means, such as a display, may also be provided on the control panel. The setting of the target locus may be instructed by any of other suitable methods such as using IC cards, bar codes, laser, and wireless communication Control functions of the control unit 9 are shown in FIG. 40. The control unit 9 has functions executed by a target locus setting calculating portion 9*a*, a front posture calculating portion 9*b*, a target cylinder speed calculating portion 9*c*, a target tip speed vector calculating portion 9*d*, a vector direction modifying portion 9*e*, a post-modification target cylinder speed calculating portion 9*f*, a target pilot pressure calculating portion 9*g*, and a valve command calculating portion 9*h*.

The target locus setting calculating portion 9*a* executes calculation for setting of the target locus along which the tip of the bucket 1*c* is to be moved, in response to an instruction from the setting device 7. One example of a manner of setting the target locus will be described with reference to FIG. 5. Note that, in this embodiment, the target locus is set in a vertical plane.

Figure 5:
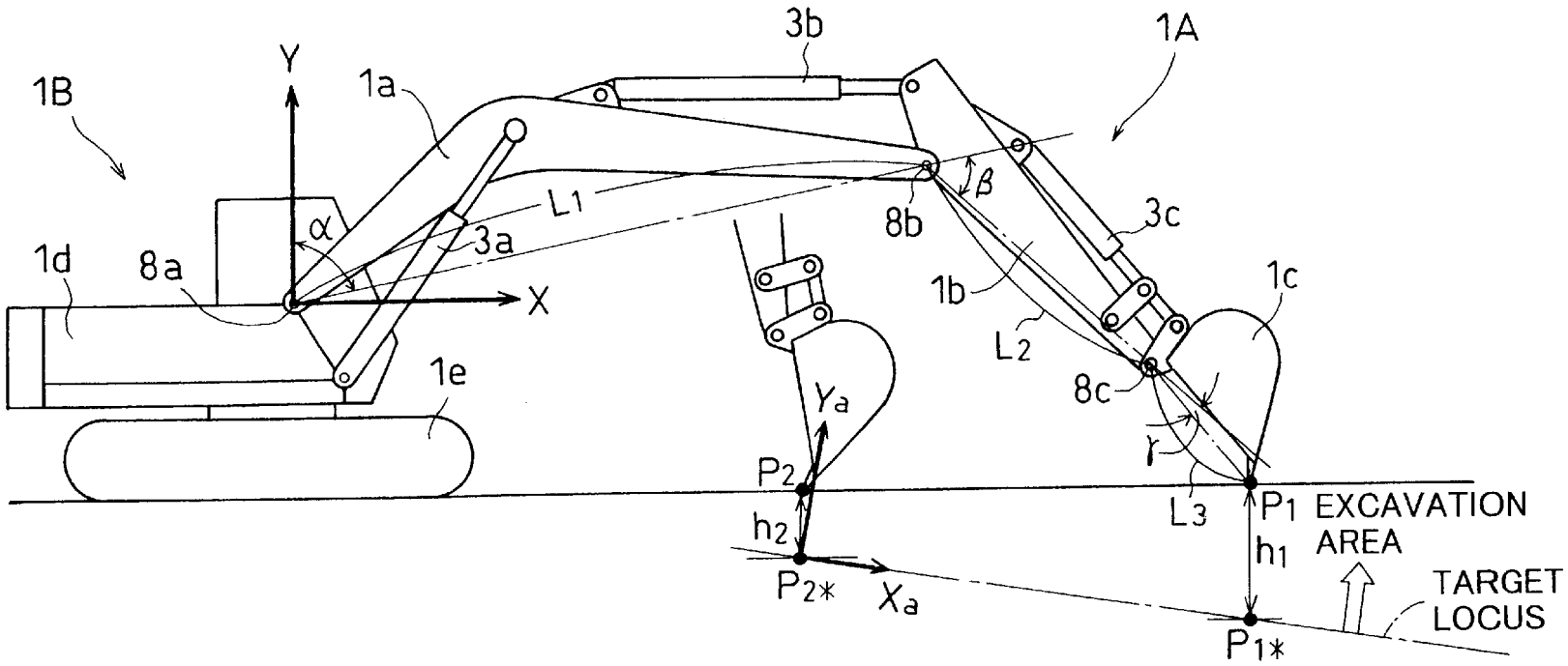
FIG. 5 is a view for explaining a method of setting a coordinate system and an area for use in locus control according to the embodiment.

In FIG. 5, after the tip of the bucket 1*c* has been moved to the position of a point P1 by the operator operating the front device, the tip position of the bucket 1*c* at that time is calculated in response to an instruction from the setting device 7, and the setting device 7 is then operated to input a depth h1 from that position to designate a point P1* on the target locus to be set. Subsequently, in a like manner to the above, after the tip of the bucket 1*c* has been moved to the position of a point P2, the tip position of the bucket 1*c* at that time is calculated in response to an instruction from the setting device 7, and the setting device 7 is then operated to input a depth h2 from that position to designate a point P2* on the target locus to be set. A formula expressing the straight line connecting the two points P1* and P2* is calculated and set as the target locus.

In the above process, the positions of the two points P1, P2 are calculated by the front posture calculating portion 9*b* described later, and the target locus setting calculating portion 9*a* calculates the formula of the straight line from information on the positions of those two points. More specifically, the control unit 9 stores various dimensions of the front device 1A and the body 1B, and the front posture calculating portion 9*b* calculates the positions of the two points P1, P2 based on the stored data and values of the rotational angles α, β, γ detected respectively by the angle sensors 8*a*, 8*b*, 8*c*. At this time, the positions of the two points P1, P2 are determined, by way of example, as coordinate values (X1, Y1), (X2, Y2) on an XY-coordinate system with the origin defined as the pivot point of the boom 1*a*. The XY-coordinate system is a rectangular coordinate system fixed on the body 1B and is assumed to lie in a vertical plane. Given that the distance between the pivot point of the boom 1*a* and the pivot point of the arm 1*b* is L1, the distance between the pivot point of the arm 1*b* and the pivot point of the bucket 1*c* is L2, and the distance between the pivot point of the bucket 1*c* and the tip of the bucket 1*c* is L3, the coordinate values (X1, Y1), (X2, Y2) on the XY-coordinate system are derived from the rotational angles α, β, γ by using formulae below.

$$X=L1 \sin \alpha+L2 \sin (\alpha+\beta)+L3 \sin (\alpha+\beta+\gamma)$$

$$Y=L1 \cos \alpha+L2 \cos (\alpha+\beta)+L3 \cos (\alpha+\beta+\gamma)$$

The target locus setting calculating portion 9*a* determines the coordinate values of the two points P1*, P2* on the boundary of an excavation area, i.e., on the target locus, by calculating the Y-coordinate values as follows.

$$Y1^*=Y1-h1$$

$$Y2^*=Y2-h2$$

The formula expressing the straight line connecting the two points P1* and P2* is calculated from the following equation.

$$Y=(Y2^*-Y1^*)X/(X2-X1)+(X2Y1^*-X1Y2^*)/(X2-X1)$$

Then, a rectangular coordinate system having the origin on the above straight line and one axis defined by the above straight line; e.g., an XaYa-coordinate system with the origin defined as the point P2*, is set and coordinate transform data from the XY-coordinate system into the XaYa-coordinate system is derived.

Figure 6:
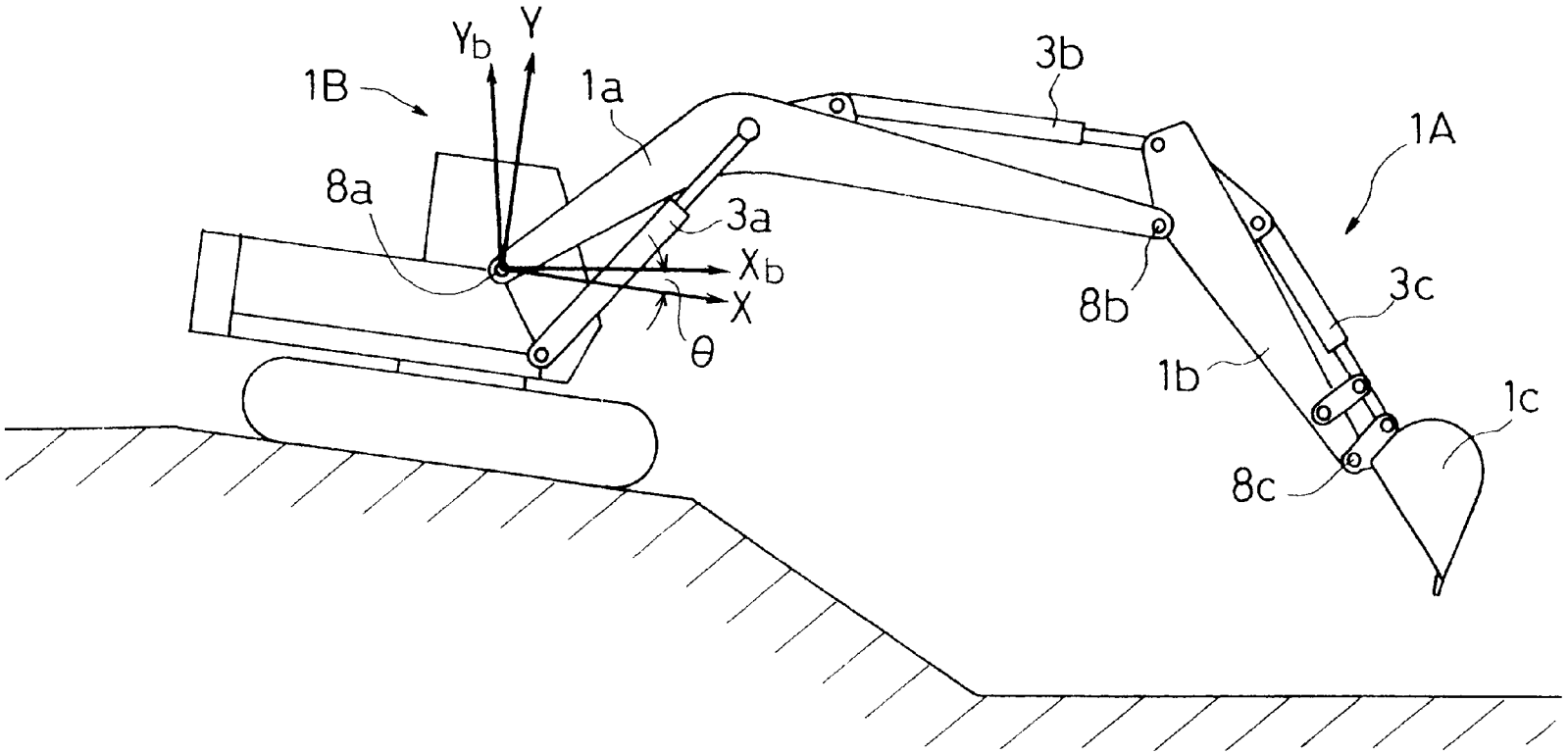
FIG. 6 is a view for explaining a method of modifying a tilt angle.

Assuming now that when the body 1B is tilted, by way of example, as shown in FIG. 6, the relative positional relationship between the bucket tip and the ground is changed and the setting of the excavation area cannot be correctly performed. In this embodiment, therefore, the tilt angle θ of the body 1B is detected by the tilt angle sensor 8*d* and a detected value of the tilt angle θ is input to the front posture calculating portion 9*b* which calculates the tip position of the bucket on an XbYb-coordinate system which is provided by rotating the XY-coordinate system through the angle θ. This enables the excavation area to be correctly set even if the body 1B is tilted. Note that the tilt angle sensor is not always required when work is started after correcting a tilt of the body if the body is tilted, or when excavation is performed in the work site where the body will not tilt.

Figure 7:
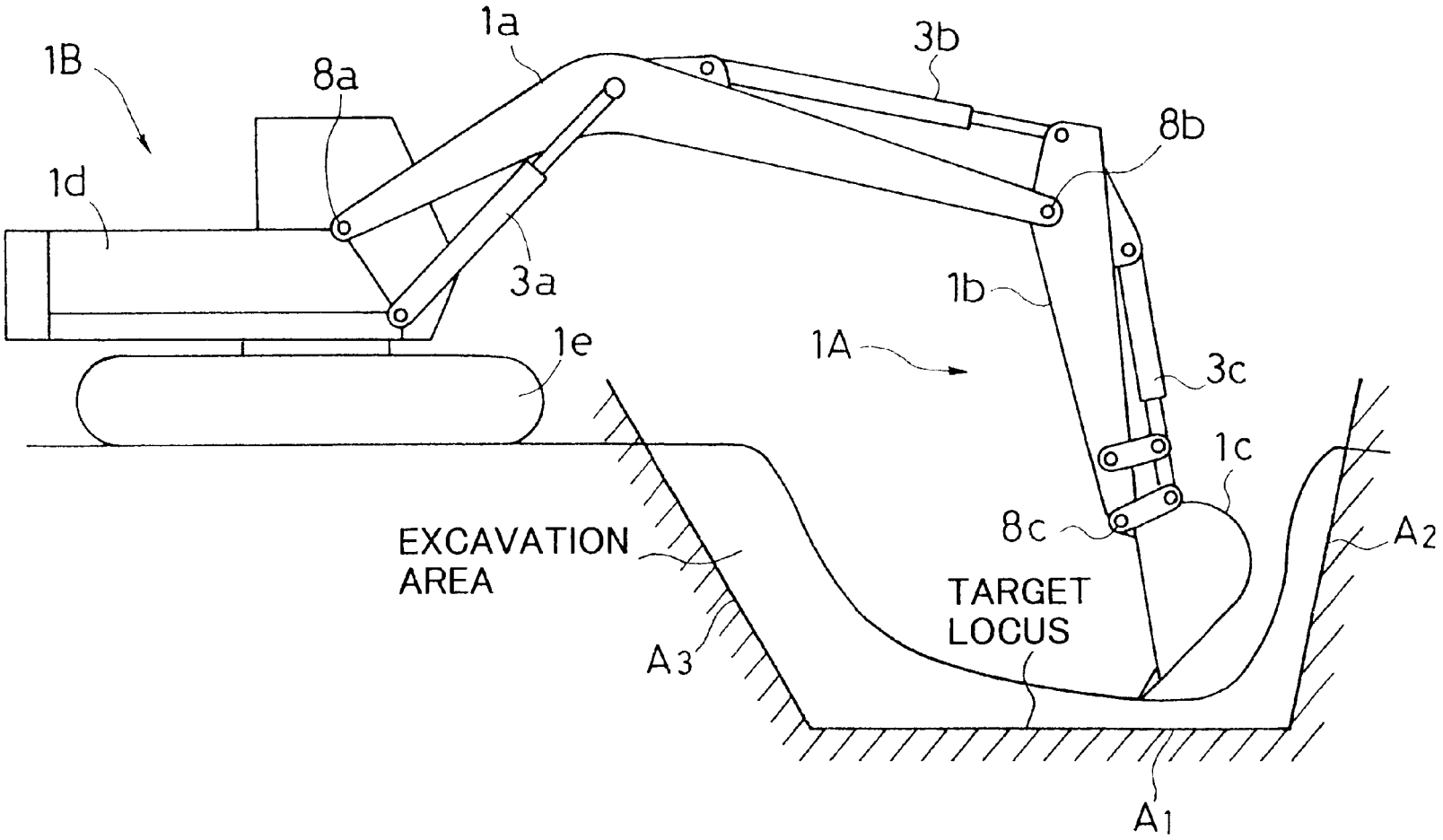
FIG. 7 is a view showing one example of the target locus set in the embodiment.
Figure 8:
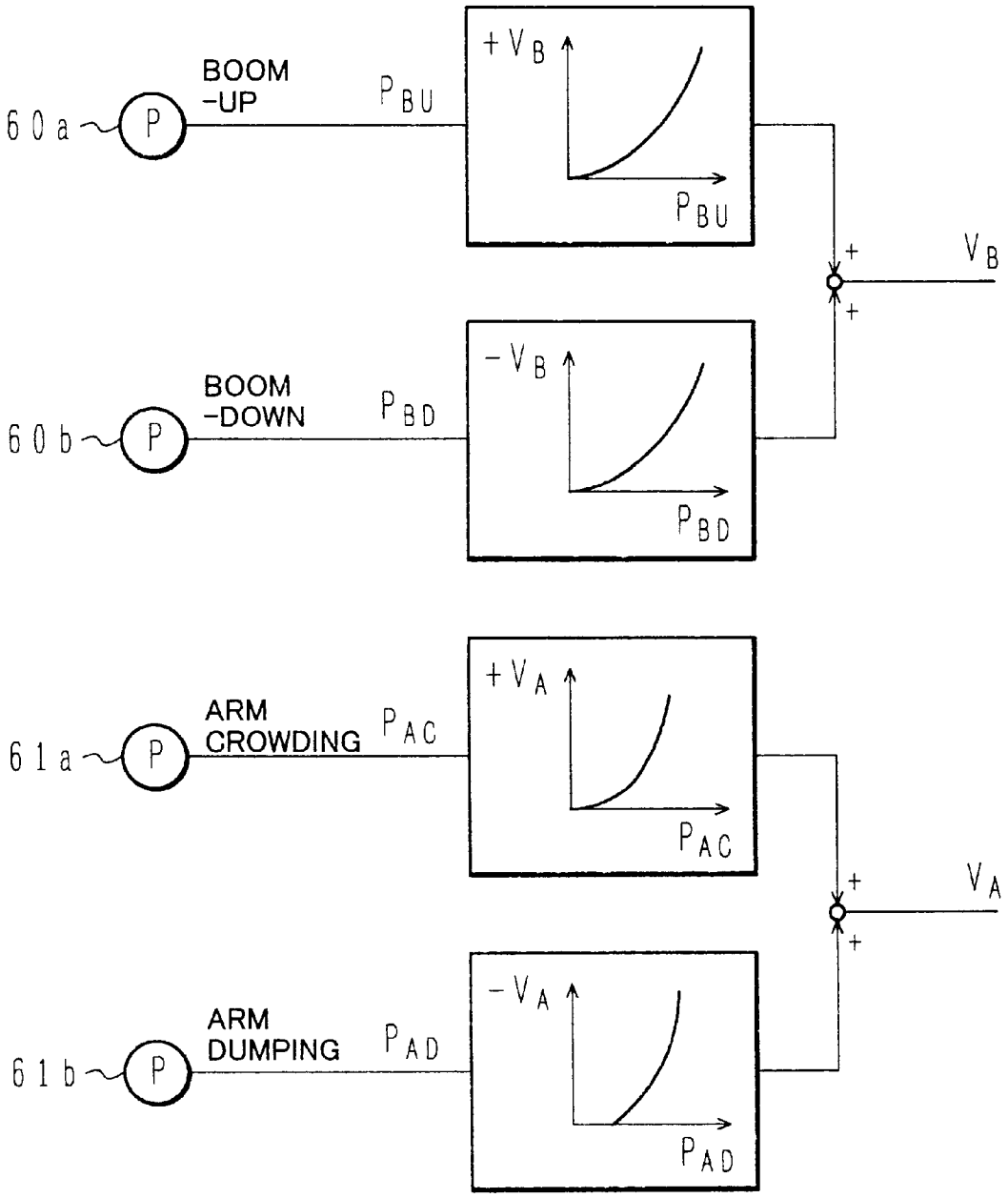
FIG. 8 is a diagram showing the relationship between a pilot pressure and a delivery rate through a flow control valve in a target cylinder speed calculating portion.

While the boundary of the excavation area is set by a single straight line in the above example, the excavation area having any desired shape in a vertical plane can be set by combining a plurality of straight lines with each other. FIG. 7 shows one example of the latter case in which the excavation area is set by using three straight lines A1, A2 and A3. In this case, the boundary of the excavation area can be set by carrying out the same operation and calculation as mentioned above for each of the straight lines A1, A2 and A3.

As explained above, the front posture calculating portion 9*b* calculates the position of a predetermined part of the front device 1A as the coordinate values on the XY-coordinate system based on the various dimensions of the front device 1A and the body 1B which are stored in a memory of the control unit 9, as well as the values of the rotational angles α, β, γ detected respectively by the angle sensors 8*a*, 8*b*, 8*c*.

The target cylinder speed calculating portion 9*c* receives values of the pilot pressures detected by the pressure sensors 60*a*, 60*b*, 61*a*, 61*b*, determines flow rates delivered through the flow control valves 5*a*, 5*b*, and calculates target speeds of the boom cylinder 3*a* and the arm cylinder 3*b* from the determined delivery flow rates. The memory of the control unit 9 stores the relationships between pilot pressures $P_{BU}$, $P_{BD}$, $P_{AC}$, $P_{AD}$ and delivery flow rates $V_B$, $V_A$ through the flow control valves 5*a*, 5*b* as shown in FIG. 8B The target cylinder speed calculating portion 9*c* determines the delivery flow rates through the flow control valves 5*a*, 5*b* based on those relationships. As an alternative, the target cylinder speed may be determined from the pilot pressure directly by storing, in the memory of the control unit 9, the relationship between the pilot pressure and the target cylinder speed that has been calculated beforehand.

The target tip speed vector calculating portion 9*d* determines a target speed vector $V_C$ at the tip of the bucket 1*c* from the tip position of the bucket 1*c* determined by the front posture calculating portion 9*b*, the target cylinder speed determined by the target cylinder speed calculating portion 9*c*, and the various dimensions, such as L1, L2 and L3, stored in the memory of the control unit 9. At this time, the target speed vector $V_C$ is first determined as values on the XY-coordinate system shown in FIG. 5, and then determined as values on the XaYa-coordinate system by transforming the values on the XY-coordinate system into the values on the XaYa-coordinate system using the transform data from the XY-coordinate system to the XaYa-coordinate system previously determined by the target locus setting calculating portion 9*a*. Here, an Xa-coordinate value $V_{Cx}$ of the target speed vector $V_C$ on the XaYa-coordinate system represents a vector component of the target speed vector $V_C$ in the direction parallel to the target locus, and a Ya-coordinate value $V_{Cy}$ of the target speed vector $V_C$ on the XaYa-coordinate system represents a vector component of the target speed vector $V_C$ in the direction vertical to the target locus.

When the tip of the bucket 1*c* is positioned within a predetermined area (described later) near the target locus, the vector direction modifying portion 9*e* modifies the target speed vector $V_C$ so that the tip of the bucket 1*c* settles to the target locus.

Figure 9:
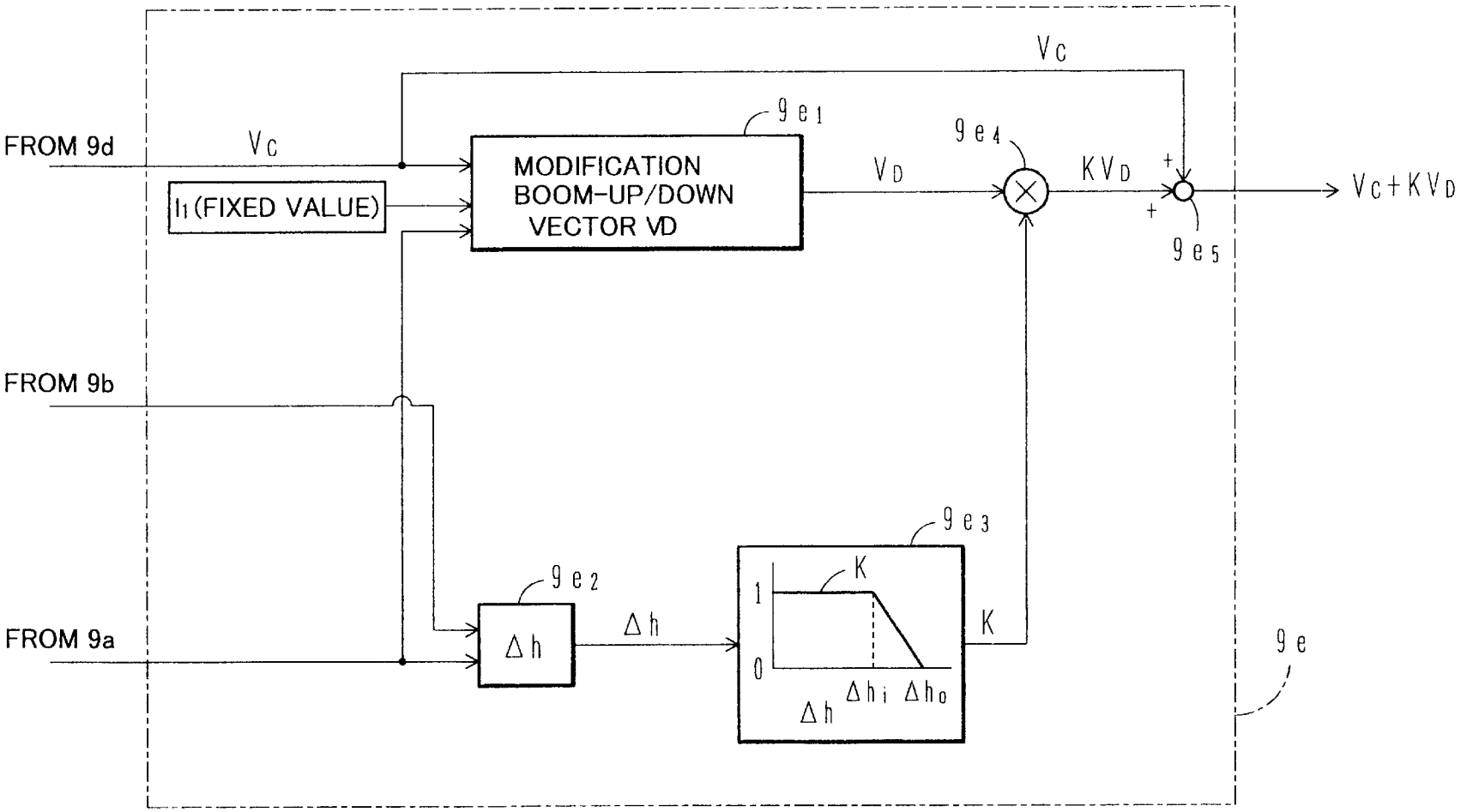
FIG. 9 is a block diagram showing a control process in a vector direction modifying portion.

FIG. 9 is a block diagram showing a control process in the vector direction modifying portion 9*e*.

Figure 10:
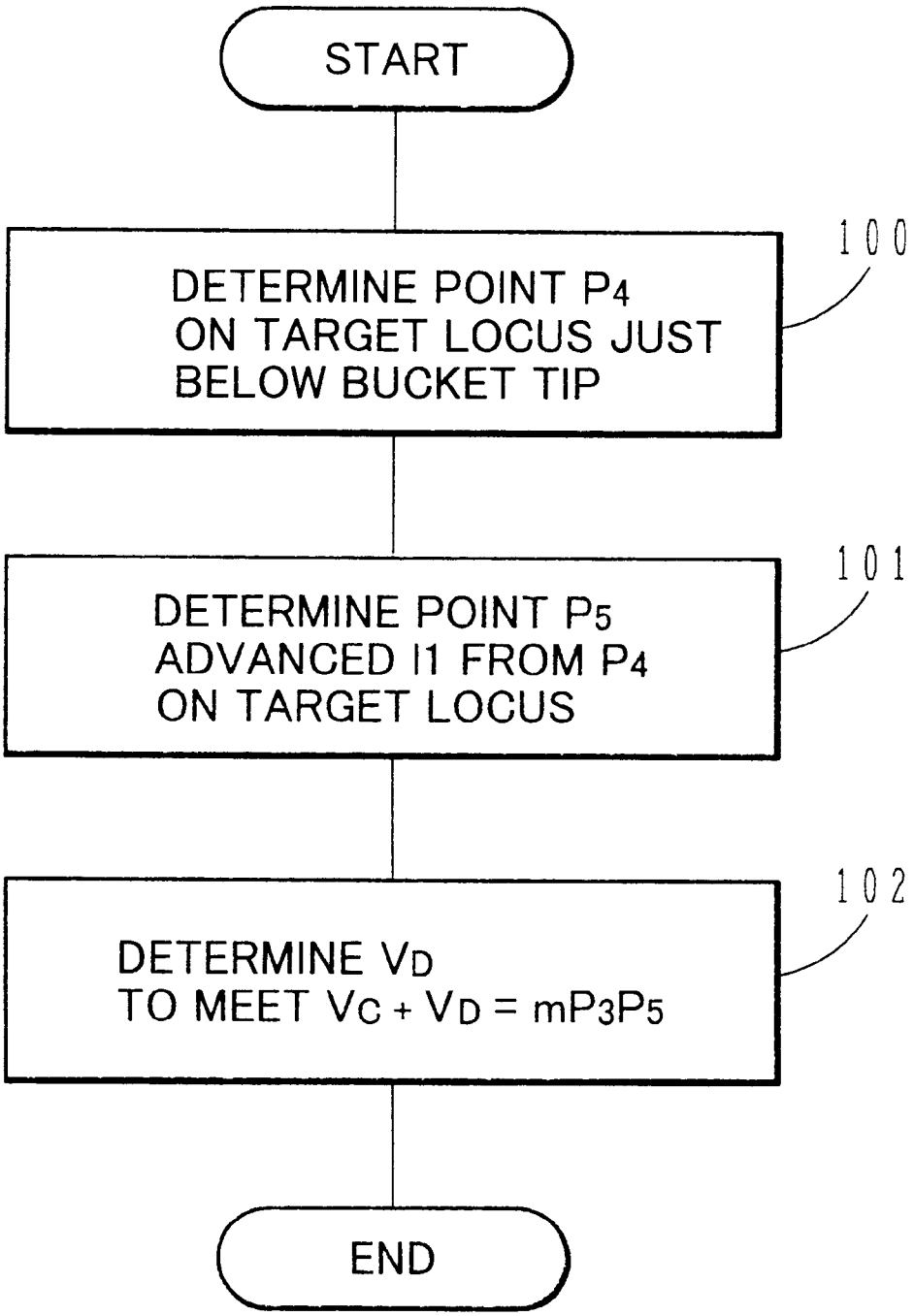
FIG. 10 is a flowchart showing a procedure of processing in a modification boom-up/down vector calculating portion
Figure 11:
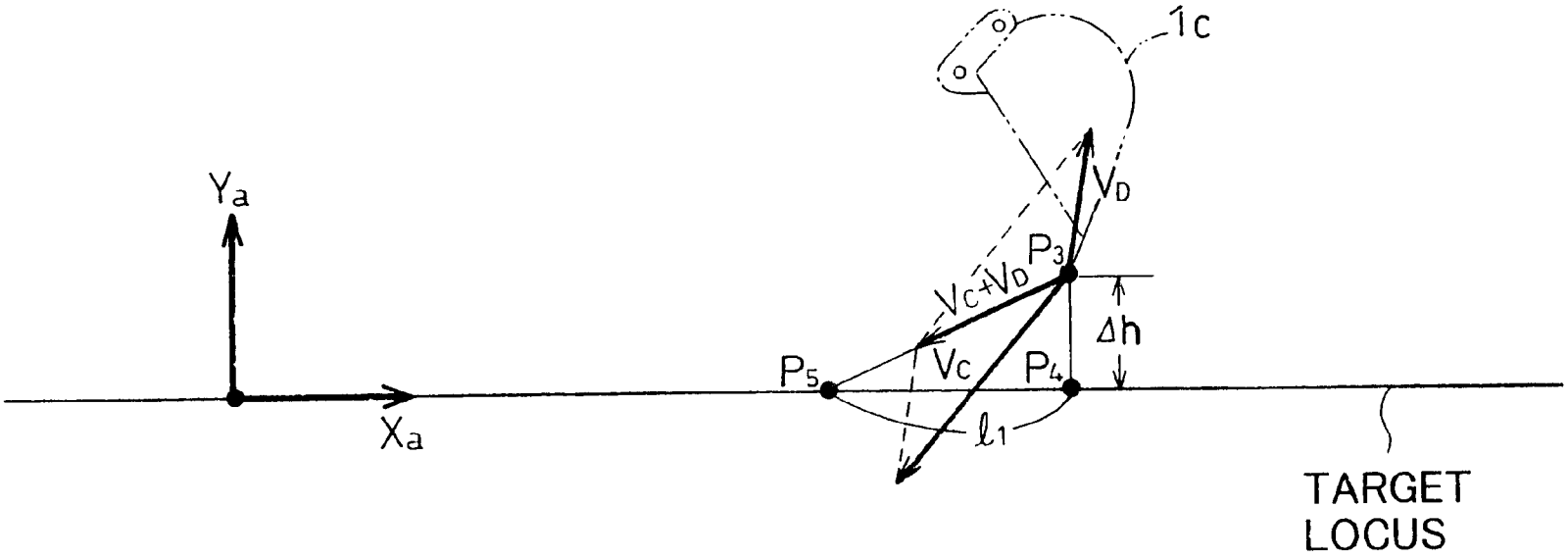
FIG. 11 is an explanatory view showing contents of the processing in the modification boom-up/down vector calculating portion.

In FIG. 9, first, a modification boom-up/down vector calculating portion 9*e*1 calculates a boom-up vector (or boom-down vector) $V_D$, as a modification vector for modifying the target speed vector $V_C$, based on the target speed vector $V_C$ calculated by the target tip speed vector calculating portion 9*d*, the target locus set by the target locus setting calculating portion 9*a*, and a second distance, e.g., l1, set by and stored in the control unit 9 beforehand FIG. 10 is a flowchart showing a procedure of processing in the modification boom-up/down vector calculating portion 9*e*1 and FIG. 11 is an explanatory view showing contents of the processing.

In FIG. 10, a point P4 on the target locus away from the tip P3 of the bucket 1*c* by a first distance, e.g. a minimum distance(see FIG. 11), is first determined in step 100.

Next, a point P5 on the target locus advanced in the excavating direction by the distance l1 from the point P4 (see FIG. 11) is determined in step 101.

The magnitude of the boom-up vector (or boom-down vector) $V_D$ is then determined in step 102 to meet the relationship of $V_C+V_D$=mP3P5 (where m is a coefficient), i.e., so that the direction of $V_C+V_D$ is the same as that of a vector P3P5.

In this way, the boom-up vector (or boom-down vector) $V_D$ for modification is determined Whether $V_D$ is a boom-up vector or a boom-down vector in the above process depends on the direction of the target speed vector $V_C$. Stated otherwise, $V_D$ is a boom-up vector when the target speed vector $V_C$ points downward of a satisfactory path (see FIG. 12 described later) for access to the target locus, and a boom-down vector when it points upward of the satisfactory path.

Returning to FIG. 9, a minimum distance detecting portion 9*e*2 determines a minimum distance Δh from the bucket tip to the target locus based on the target locus set by the target locus setting calculating portion 9*a* and the tip position of the bucket 1*c* determined by the front posture calculating portion 9*b*.

Then, a control gain setting portion 9*e*3 sets a control gain K based on the minimum distance Δh. As shown in FIG. 9, the control gain K is set to have a value which is equal to 0 when the minimum distance Δh is greater than a predetermined value Δho, is equal to 1 when Δh is smaller than a predetermined value Δhi, and increases from 0 to 1 continuously as Δh reduces when it is in the range of Δhi≦Δh≦Δho.

The control gain K thus derived is multiplied in a multiplier 9*e*4 by the boom-up vector (or boom-down vector) V*D* determined by the modification boom-up/down vector calculating portion 9*e*1 in the manner explained above.

After that, the target speed vector $V_C$ from the target tip speed vector calculating portion 9*d* is added to $KV_D$ from the multiplier 9*e*4 in an adder 9*e*5, and $V_C+KV_D$ is finally output from the vector direction modifying portion 9*e*.

Here, since the value of the control gain K is set by the control gain setting portion 9*e*3 as described above, the output of the vector direction modifying portion 9*e* takes a value equal to $V_C$ when Δh>Δho is satisfied, equal to $V_C+V_D$ when Δh<Δhi is satisfied, and in the range of $V_C$ to $V_C+V_D$ when Δhi≦Δh≦Δho is satisfied. In other words, when the minimum distance Δh from the tip of the bucket 1*c* to the target locus is greater than Δho, this represents a non-modification area in which the target speed vector is not at all modified. When the minimum distance Δh is in the range of Δhi to Δho, this represents a transient area in which the target speed vector is modified to a larger extent as the minimum distance reduces. When the minimum distance Δh is smaller than Δhi, this represents a modification area in which the target speed vector is modified to a full extent.

As described above, by adding the boom-up vector (or boom-down vector) $V_D$ for modification to the target speed vector $V_C$, the target speed vector $V_C$ is modified to a target speed vector $V_C+KV_D$ (where K=0 to 1).

Figure 12:
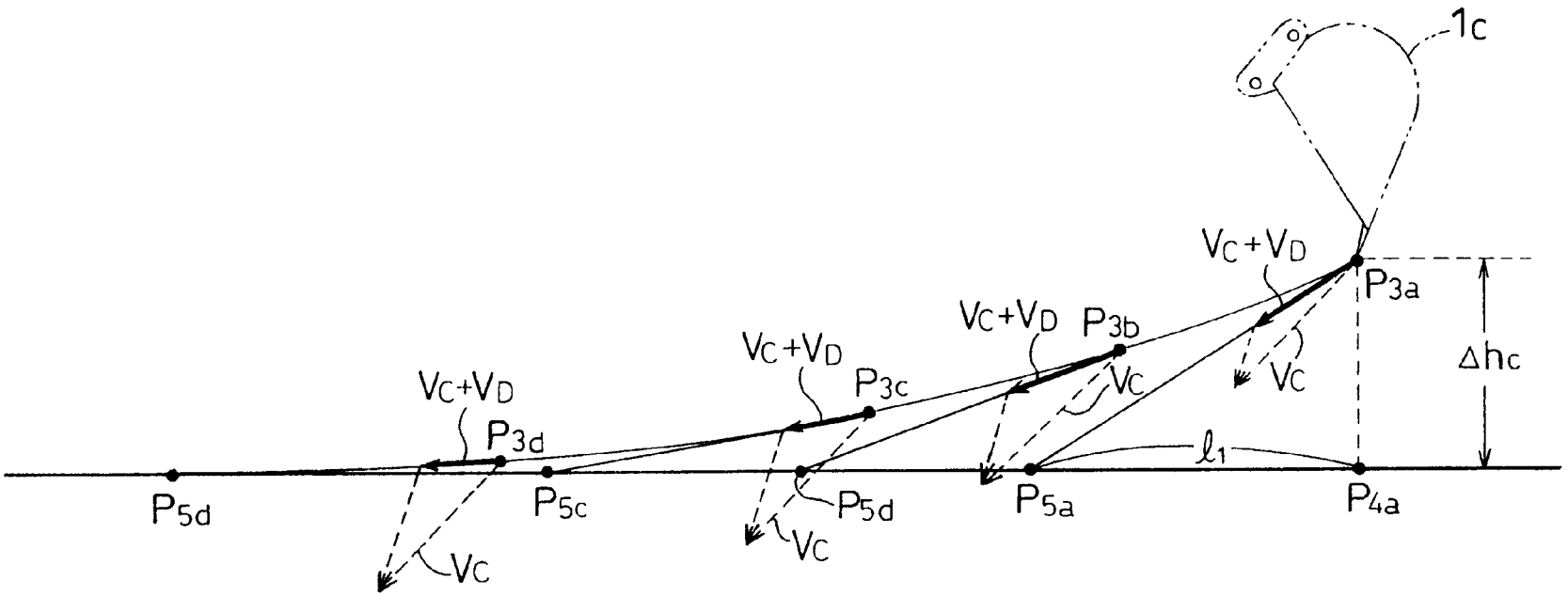
FIG. 12 is a view showing one example of a locus of a bucket tip.

FIG. 12 shows one example of a locus along which the tip of the bucket 1*c* moves when the bucket tip is controlled to have the target speed vector $V_C+V_D$ (i.e., K=1 in the area of Δh≦Δhi) through the above-described modification.

As shown in FIG. 12, assuming that the target speed vector $V_C$ is a constant vector pointing downward obliquely, it is always modified to a target speed vector $V_C+V_D$ pointing to a point advanced l1 in the excavating direction from the point on the target locus just below the tip position of the bucket 1*c* in each modification process. More specifically, given the initial tip position of the bucket 1*c* being at a point P3*a*, for example, the point on the target locus just below the tip position of the bucket 1*c* is a point P4*a*, the point advanced l1 in the excavating direction is a point P5*a*, and the target speed vector is provided as a target speed vector $V_C+V_D$ pointing to the point P5*a*. Subsequently, when the tip position of the bucket 1*c* comes to a point P3*b*, the target speed vector is provided as a target speed vector $V_C+V_D$ pointing to a point P5*b*. Then, when the tip position of the bucket 1*c* comes to a point P3*c*, the target speed vector is provided as a target speed vector $V_C+V_D$ pointing to a point P5*c* and, thereafter, when the bucket tip comes to a point P3*d*, it is provided as a target speed vector $V_C+V_D$ pointing to a point P5*d*. Eventually, as seen from FIG. 12, the locus of the bucket tip is given by a curved line coming closer to parallel relation to the target locus as approaching it and at last smoothly converging to the target locus. Even if the tip of the bucket 1*c* should deviate downward from the target locus, it is also settled to the target locus from below while following a similar smooth locus.

Returning to FIG. 4, the post-modification target cylinder speed calculating portion 9*f* calculates target cylinder speeds of the boom cylinder 3*a* and the arm cylinder 3*b* from the target speed vector $V_C+KV_D$ after modification determined by the vector direction modifying portion 9*e*. This process is a reversal of the calculation executed by the target tip speed vector calculating portion 9*d*.

The target pilot pressure calculating portion 9*g* calculates target pilot pressures in the pilot lines 44*a*, 44*b*, 45*a*, 45*b* based on the respective target cylinder speeds from the post-modification target cylinder speed calculating portion 9*f*. This process is a reversal of the calculation executed by the target cylinder speed calculating portion 9*c*. The valve command calculating portion 9*h* calculates, from the target pilot pressures calculated by the target pilot pressure calculating portion 9*g*, command values for the proportional solenoid valves 10*a*, 10*b*, 11*a*, 11*b* necessary to establish those target pilot pressures. The command values are amplified by amplifiers and output as electric signals to the proportional solenoid valves. Here, since the target speed vector $V_C$ is modified by using the boom-up vector (or boom-down vector) $V_D$ as shown in step 102 in the flowchart of FIG. 10, an electric signal corresponding to the modification is output to the proportional solenoid valve 10*a* associated with the pilot line 44*a* on the boom-up side (or the proportional solenoid valve 10*b* associated with the pilot line 44*b* on the boom-down side).

In the above arrangement, the control lever devices 4*a*–4*f* make up operating means of hydraulic pilot type for instructing operations of the plurality of members to be driven, i.e., the boom 1*a*, the arm 1*b*, the bucket 1*c*, the upper swing structure 1*d* and the under travelling carriage 1*e*. The setting device 7 and the target locus setting calculating portion 9*a* make up locus setting means for setting a target locus along which the front device 1A is to be moved. The angle sensors 8*a*–8*c* and the tilt angle sensor 8*d* constitute first detecting means for detecting status variables in relation to the position and posture of the front device 1A. The front posture calculating portion 9*b* constitutes first calculating means for calculating the position and posture of the front device 1A based on signals from the first detecting means.

Also, the points P4, P4*a* . . . each constitute a first point on the target locus away from the front device 1A by the first distance, and the points P5, P5*a*, P5*b*, P5*c*, P5*d* . . . each constitute a second point on the target locus advanced in the excavating direction by the distance l1 from the first point. The target cylinder speed calculating portion 9*c*, the target tip speed vector calculating portion 9*d*, the vector direction modifying portion 9*e*, the post-modification target cylinder speed calculating portion 9*f*, the target pilot pressure calculating portion 9*g*, the valve command calculating portion 9*h*, and the proportional solenoid valves 10*a*, 10*b*; 11*a*, 11*b* make up signal modifying means for, based on the operation signals from those ones 4*a*, 4*b* of the plurality of operating means 4*a*–4*f* which are associated with the particular front members 1*a*, 1*b* and the values calculated by the first calculating means 9*b*, modifying the operation signals from those particular operating means 4*a*, 4*b* for the front device 1A so that the front device 1A is controlled to successively move toward the points P5, P5*a*, P5*b*, P5*c*, P5*d* . . . and eventually settle to the target locus.

The target cylinder speed calculating portion 9*c* and the target tip speed vector calculating portion 9*d* make up second calculating means for calculating the target speed vector of the front device 1A based on the operation signals from the operating means 4*a*, 4*b* associated with the particular front members 1*a*, 1*b*. The vector direction modifying portion 9*e* constitutes third calculating means for receiving the values calculated by the first and second calculating means, calculating the modification vector $V_D$ to modify the target speed vector $V_C$ based on the received values, and modifying the target speed vector $V_C$ based on the modification vector $V_D$ so that the target speed vector $V_C$ points to the second point P5. The post-modification target cylinder speed calculating portion 9*f*, the target pilot pressure calculating portion 9*g*, the valve command calculating portion 9*h*, and the proportional solenoid valves 10*a*, 10*b*; 11*a*, 11*b* make up valve control means for driving the associated hydraulic control valves 5*a*, 5*b* so that the front device 1A is moved in accordance with the modified target speed vector $V_C+KV_D$.

Further, the control gain setting portion 9*e*3 and the multiplier 9*e*4 of the vector direction modifying portion 9*e* make up a modification vector altering means for altering the modification vector $V_D$ in accordance with the first distance.

The control lever devices 4*a*–4*f* and the pilot lines 44*a*–49*b* make up an operating system for driving the hydraulic control valves 5*a*–5*f*. The pressure sensors 60*a*, 60*b*; 61*a*, 61*b* constitute second detecting means for detecting input amounts by which the operating means for the front device are operated. The target cylinder speed calculating portion 9*c* and the target tip speed vector calculating portion 9*d* both making up the above second calculating means serve as means for calculating the target speed vector of the front device 1A based on signals from the second detecting means. Of the elements making up the above valve control means, the post-modification target cylinder speed calculating portion 9*f* and the target pilot pressure calculating portion 9*g* make up fourth calculating means for, based on the modified target speed vector, calculating the target pilot pressures for driving the associated hydraulic control valves 5*a*, 5*b*, while the valve command calculating portion 9*h* and the proportional solenoid valves 10*a*, 10*b*; 11*a*, 11*b* make up pilot control means for controlling the operating system so that the calculated target pilot pressures are established.

The pilot line 44*a* constitutes a first pilot line for introducing a pilot pressure to the associated hydraulic control valve 5*a* so that the front device 1A is moved away from the target locus. The post-modification target cylinder speed calculating portion 9*f* and the target pilot pressure calculating portion 9*g* make up means for calculating a target pilot pressure in the first pilot line based on the modified target speed vector. The valve command calculating portion 9*h* constitutes means for outputting a first electric signal corresponding to the target pilot pressure The proportional solenoid valve 10*a* constitutes electro-hydraulic converting means for converting the first electric signal into a hydraulic pressure and outputting a control pressure corresponding to the target pilot pressure. The shuttle valve 12 constitutes higher pressure selecting means for selecting the higher one of the pilot pressure in the first pilot line and the control pressure output from the electro-hydraulic converting means, and introducing the selected pressure to the associated hydraulic control valve 5*a*.

In addition, the pilot lines 44*b*, 45*a*, 45*b* constitute second pilot lines for introducing pilot pressures to the associated hydraulic control valves 5*a*, 5*b* so that the front device 1A is moved toward the target locus. The post-modification target cylinder speed calculating portion 9*f* and the target pilot pressure calculating portion 9*g* make up means for calculating target pilot pressures in the second pilot lines based on the modified target speed vector. The valve command calculating portion 9*h* constitutes means for outputting second electric signals corresponding to the target pilot pressures. The proportional solenoid valves 10*b*, 11*a*, 11*b* constitute pressure reducing means disposed in the second pilot lines and operated in accordance with the second electric signals for reducing the pilot pressures in the second pilot lines to the target pilot pressures.

Operation of this embodiment thus constructed will be described below. The following description will be made on, as examples of work, (1) the case of pulling the bucket tip in the horizontal direction (i.e., so-called level pulling), and (2) the case of pushing the bucket tip in the horizontal direction (i.e., so-called level pushing).

(1) Level Pulling

1 Settling to target locus (arm crowding operation)

In this case, the operator first performs the arm crowding operation, for example, to make the tip of the bucket 1*c* approach the target locus from above the target locus. At this time, when the minimum distance Δh between the bucket tip and the target locus becomes smaller than Δho, modification of the target speed vector $V_C$ is started by the vector direction modifying portion 9*e* which produces the boom-up vector (or boom-down vector) $V_D$ for modifying the target speed vector $V_C$ so that the target speed vector $V_C$ points to the point P5, etc. advanced l1 in the excavating direction from the point P4, etc. on the target locus just below the tip position of the bucket 1*c*, and then adds $KV_D$, resulted from multiplying $V_D$ by the control gain K, to $V_C$. The control gain K takes a larger value as the minimum distance Δh between the bucket tip and the target locus comes closer to Δhi, and becomes equal to 1 (K=1) at Δh=Δhi. At the minimum distance Δh smaller than Δhi, the target speed vector $V_C$ is always modified to $V_C$+V*D*.

Subsequently, the post-modification target cylinder speed calculating portion 9*f* calculates a cylinder speed in the direction of extending (or contracting) the boom cylinder 3*a* and a cylinder speed in the direction of extending the arm cylinder 3*b* corresponding to the modified target speed vector $V_C+V_D$. The target pilot pressure calculating portion 9*g* calculates a target pilot pressure in the boom-up side pilot line 44*a* (or the boom-down side pilot line 44*b*) and a target pilot pressure in the arm-crowding side pilot line 45*a*, and the valve command calculating portion 9*h* outputs electric signals to the proportional solenoid valves 10*a* (or 10*b*) and 11*a*. Thus, the proportional solenoid valve 10*a* carries out a pressure reduction to a control pressure corresponding to the target pilot pressure calculated by the target pilot pressure calculating portion 9*g*, and the control pressure is selected by the shuttle valve 12 and introduced to the boom-up side hydraulic driving sector 50*a* of the boom flow control valve

5*a* (or the proportional solenoid valve 10*b* carries out a pressure reduction to a control pressure corresponding to the target pilot pressure calculated by the target pilot pressure calculating portion 9*g*, and the control pressure is introduced to the boom-down side hydraulic driving sector 50*b* of the boom flow control valve 5*a*). Similarly, the proportional solenoid valve 11*a* carries out a pressure reduction to a control pressure corresponding to the target pilot pressure calculated by the target pilot pressure calculating portion 9*g*, and the control pressure is introduced to the arm-crowding side hydraulic driving sector 51*a* of the arm flow control valve 5*b*. In the above process, since the proportional solenoid valve 1*a* (or 10*b*) is operated in accordance with the electric signal derived from the sum of the target speed vector $V_C$ and the boom-up vector (or boom-down vector) $V_D$ for modifying it, the tip of the bucket 1*c* can be eventually moved so that it is smoothly settled to the target locus while following the path shown in FIG. 12.

As described above, unlike the conventional system wherein which path the tip of the bucket 1*c* follows until reaching the target locus is not definite but depends on the operation of the operator, this embodiment enables the tip of the bucket 1*c* to settle to the target locus in a relatively quick, stable and highly accurate manner through a satisfactory path in match with a human feeling.

2 First half of level pulling (combined operation of arm crowding and boom-up)

After the tip of the bucket 1*c* has reached the target locus in a smooth manner as described above <1>, the operator intends to move the tip of the bucket 1*c* along the target locus by, for example, the combined operation of arm crowding and boom-up. At this time, if the tip of the bucket 1*c* is going to deviate downward or upward from the target locus, the vector direction modifying portion 9*e* always modifies the target speed vector to $V_C+V_D$ (where $V_D$ is the boom-up or boom-down vector) as described above <1>, since the minimum distance Δh between the tip of the bucket 1*c* and the target locus is sufficiently small. Then, the post-modification target cylinder speed calculating portion 9*f* calculates a cylinder speed in the direction of extending (or contracting) the boom cylinder 3*a* and a cylinder speed in the direction of extending the arm cylinder 3*b* corresponding to the modified target speed vector $V_C+VD$. The target pilot pressure calculating portion 9*g* calculates a target pilot pressure in the boom-up side pilot line 44*a* (or the boom-down side pilot line 44*b*) and a target pilot pressure in the arm-crowding side pilot line 45*a*, and the valve command calculating portion 9*h* outputs electric signals to the proportional solenoid valves 10*a* (or 10*b*) and 11*a*. Thus, the proportional solenoid valves 10*a* (or 10*b*) and 11*a* carry out a pressure reduction to respective control pressures corresponding to the target pilot pressures calculated by the target pilot pressure calculating portion 9*g*, and the control pressures are introduced to the boom-up side hydraulic driving sector 50*a* (or the boom-down side hydraulic driving sector 50*b*) of the boom flow control valve 5*a* and the arm-crowding side hydraulic driving sector 51*a* of the arm flow control valve 5*b*. In the above process, since the proportional solenoid valve 10*a* (or 10*b*) is operated in accordance with the electric signal derived from the sum of the target speed vector $V_C$ and the boom-up vector (or boom-down vector) $V_D$ for modifying it, the tip of the bucket 1*c* can be eventually moved along the target locus without deviating downward (or upward) from the target locus.

3 Second half of level pulling (combined operation of arm crowding and boom-down)

When the operator continues excavation along the target locus toward the body through the operation described above <2> and reaches a certain position rather near the body, the operator shifts an operating mode to the combined operation of arm crowding and boom-down, for example, in order to move the tip of the bucket 1*c* along the target locus continuously. Control in this case is substantially the same as in the above <2>. If the tip of the bucket 1*c* is going to deviate downward or upward from the target locus, the target speed vector is always modified to $V_C+V_D$ (where $V_D$ is the boom-up or boom-down vector), and cylinder speeds corresponding to the modified target speed vector $V_C+V_D$ are calculated. Then, the proportional solenoid valves 10*a* (or 10*b*) and 11*a* carry out a pressure reduction to respective control pressures corresponding to the calculated target pilot pressures, and the control pressures are introduced to the boom-up side hydraulic driving sector 50*a* (or the boom-down side hydraulic driving sector 50*b*) of the boom flow control valve 5*a* and the arm-crowding side hydraulic driving sector 51*a* of the arm flow control valve 5*b*. As a result, the tip of the bucket lo can be eventually moved along the target locus without deviating downward (or upward) from the target locus.

During the excavation made along the target locus through the above operations <2> and <3>, it sometimes desired for the operator to manually instruct the boom 1*a* to rise, for example, when the bucket 1*c* has become full of earth and sand, or when an obstacle has appeared halfway, or when excavation resistance should be reduced because the front device has stopped owing to excessive excavation resistance. In such a case, the operator only operates the boom control lever device 4*a* in the boom-up direction Upon the operation, a pilot pressure is developed in the boom-up side pilot line 44*a* and, when the pilot pressure exceeds the control pressure produced by the proportional solenoid valve 10*a*, it is selected by the shuttle valve 12, allowing the boom to rise.

(2) Level Pushing

In this case, a basic control process is the same as that in the above (1) <1> to <3> except that the operator proceeds with the operation in the sequence of <1> the arm dumping operation causing the bucket tip to settle to the target locus→<2> the combined operation of arm dumping and boom-up (first half)→<3> the combined operation of arm dumping and boom-down (second half). In the operation <1>, the tip of the bucket 1*c* can be settled to the target locus in a relatively quick, stable and highly accurate manner through a satisfactory path in match with a human feeling. In the operations <2> and <3>, the tip of the bucket 1*c* can be moved along the target locus without deviating downward (or upward) from the target locus.

With this embodiment, as described above, in the case of controlling the tip of the bucket 1*c* to approach and settle to the target locus, the target speed vector $V_C$ is not modified and work can be performed in the same manner as usual, when the tip of the bucket 1*c* is far away from the target locus. When the tip of the bucket 1*c* comes close to the target locus, control for modifying the direction of the target speed vector is made so that the tip of the bucket 1*c* can be settled to the target locus in a relatively quick, stable and highly accurate manner through a satisfactory path in match with a human feeling.

Also, since the locus control is made by incorporating the proportional solenoid valves 10*a*, 10*b*, 11*a*, 11*b* and the shuttle valve 12 in the pilot lines 44*a*, 44*b*, 45*a*, 45*b* and controlling pilot pressures, a function of enabling excavation to be efficiently performed in a limited area can be easily added to any system having the control lever devices 4*a*, 4*b* of hydraulic pilot type.

In the above embodiment, the vector direction modifying portion 9*e* employs the modification boom-up/down vector $V_D$ to modify the target speed vector $V_C$, but the present invention is not limited thereto. Instead of or in combination with the modification boom-up/down vector V*D*, a modification arm-crowding/dumping vector $V_E$ (not shown) may be produced and employed. In this case, an electric signal for finally actuating the proportional solenoid valve 11*a* (or 11*b*) is produced after being added with a component corresponding to the arm-crowding (or arm-dumping) vector $V_E$ for modifying the target speed vector $V_C$.

Further, in the above embodiment, the target speed vector is always modified when the bucket tip is within the predetermined area from the target locus, regardless of whether the operation signals detected by the pressure sensors 60*a*, 60*b*; 61*a*, 61*b* are operation signals moving the bucket tip toward the target locus or operation signals moving the bucket tip away from the target locus. However, the present invention is not limited thereto, but may be arranged to carry out no modification at all when the bucket tip is operated in the direction away from the target locus (e.g., by the boom-up operation). With this arrangement, the control process can be further simplified and the bucket tip can be more smoothly moved away from the target locus when it should depart from the vicinity of the target locus.

Additionally, while the distance l1 on the target locus for use in the vector direction modifying portion 9*e* of the control unit 9 is a fixed value in the above embodiment, the distance l1 may be a variable value in variations of the vector direction modifying portion 9*e*. For example, the distance l1 may be variable depending on Δh, or the operation signal for the boom or the arm, or the moving speed of the boom or the arm. Several variations of the vector direction modifying portion 9*e* which employ any of the above examples and include other functions added to the control unit 9, as needed, will be described below.

1 Variation using l1 variable depending on Δh

Figure 13:
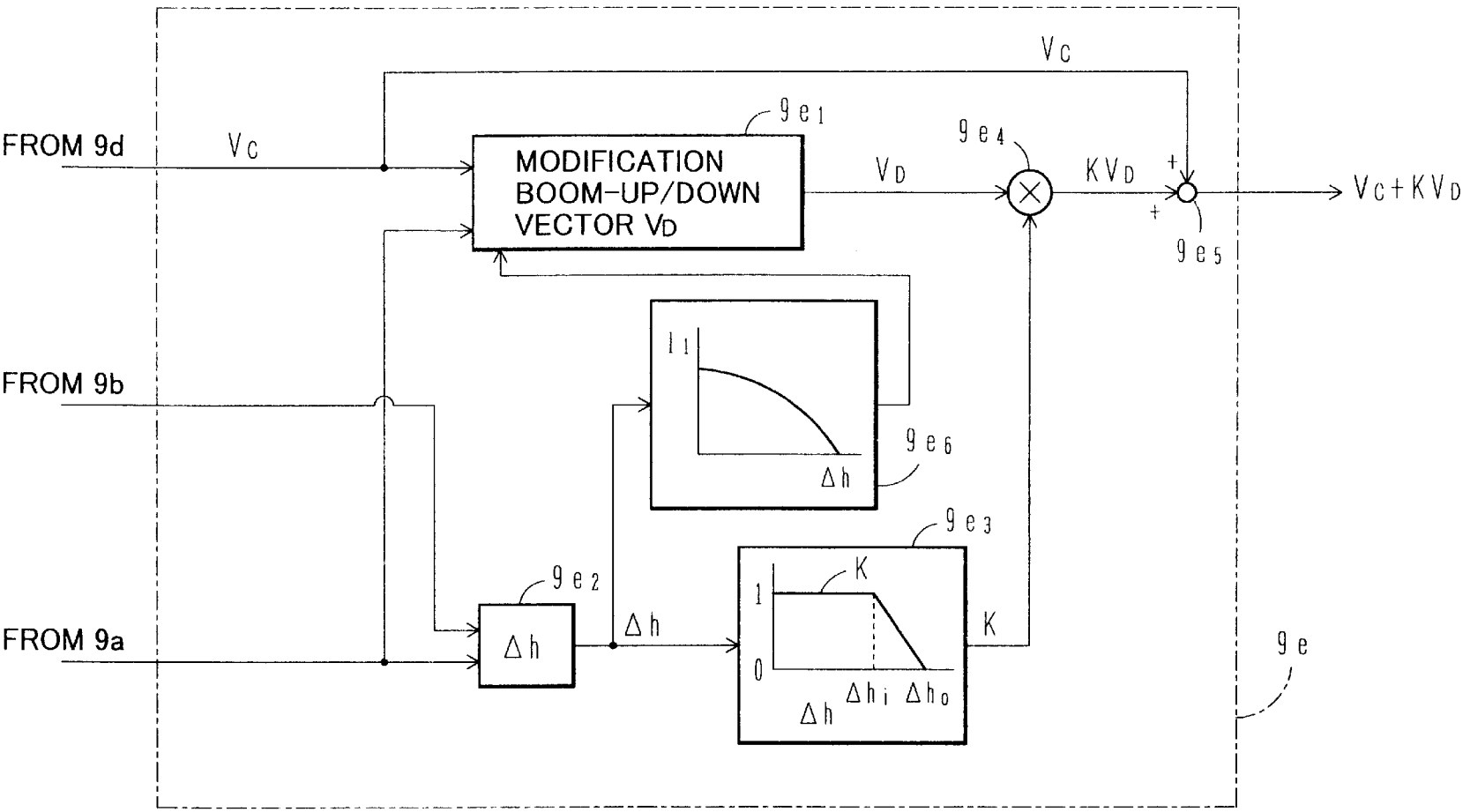
FIG. 13 is a block diagram showing a control process in a variation of the vector direction modifying portion.

A block diagram representing a control process in this variation of the vector direction modifying portion 9*e* is shown in FIG. 13. FIG. 13 is primarily different in configuration from FIG. 9 in that a l1 setting portion 9*e*6 is additionally provided which variably sets l1 depending on Δh detected by a minimum distance detecting portion 9*e*2. Then, by using a table as shown, l1 is set to have a greater value as Δh reduces, and a smaller value as Δh increases. The value of l1 is output to the modification boom-up/down vector calculating portion 9*e*1.

With this variation, when the minimum distance Δh is relatively large, the distance l1 takes a relatively small value and hence the bucket tip can be more quickly settled to the target locus. Also, when the minimum distance Δh is relatively small, the distance l1 takes a relatively large value and hence the bucket tip can be more smoothly and softly settled to the target locus.

Figure 14:
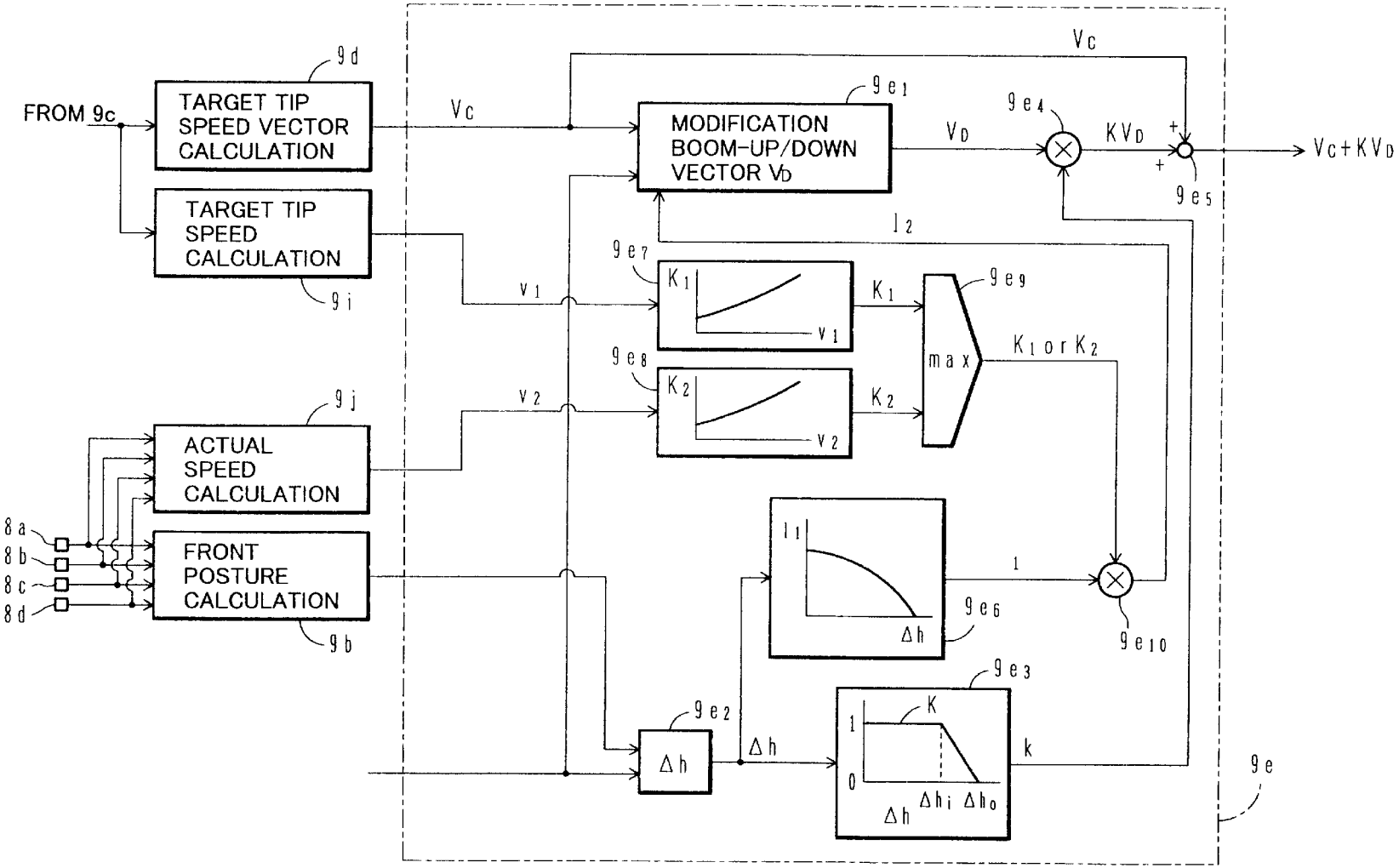
FIG. 14 is a block diagram showing a control process in another variation of the vector direction modifying portion.

2 Variation using l1 variable depending on a selected one of operation signal for boom/arm and moving speed of boom/arm A block diagram representing a control process in this variation of the vector direction modifying portion 9*e* is shown in FIG. 14. Functions newly added to the control unit 9 corresponding to the variation are also shown in FIG. 14. FIG. 14 is primarily different in configuration from FIG. 13 as follows. First, the control unit 9 further comprises a target tip speed calculating portion 9*i* for determining a target tip speed v1 of the boom 1*a* based on the target cylinder speed determined by the target cylinder speed calculating portion 9*c* and the various dimensions, such as L1, L2 and L3, stored in the memory of the control unit 9, and an actual speed calculating portion 9*j* for determining an actual speed v2 of the boom 1*a* at its tip based on the various dimensions such as L1, L2 and L3 and the values of the rotational angles α, β, γ, θ detected respectively by the angle sensors 8*a*, 8*b*, 8*c*, 8*d*. Also, the vector direction modifying portion 9*e* additionally includes a modification gain calculating portion 9*e*7 for determining a modification gain K1 based on the target tip speed v1 from the target tip speed calculating portion 9*i*, a modification gain calculating portion 9*e*8 for determining a modification gain K2 based on the actual speed v2 from the actual speed calculating portion 9*j*, a maximum value selecting portion 9*e*9 for selecting a maximum one of the modification gains K1, K2, and a multiplier 9*e*10 for multiplying the selected K1 or K2 by l1 from the l1 setting portion 9*e*6 to produce l2. Further, the modification boom-up/down vector calculating portion 9*e*1 calculates the boom-up vector $V_D$ by using l2 from the multiplier 9*e*10.

Figure 15:
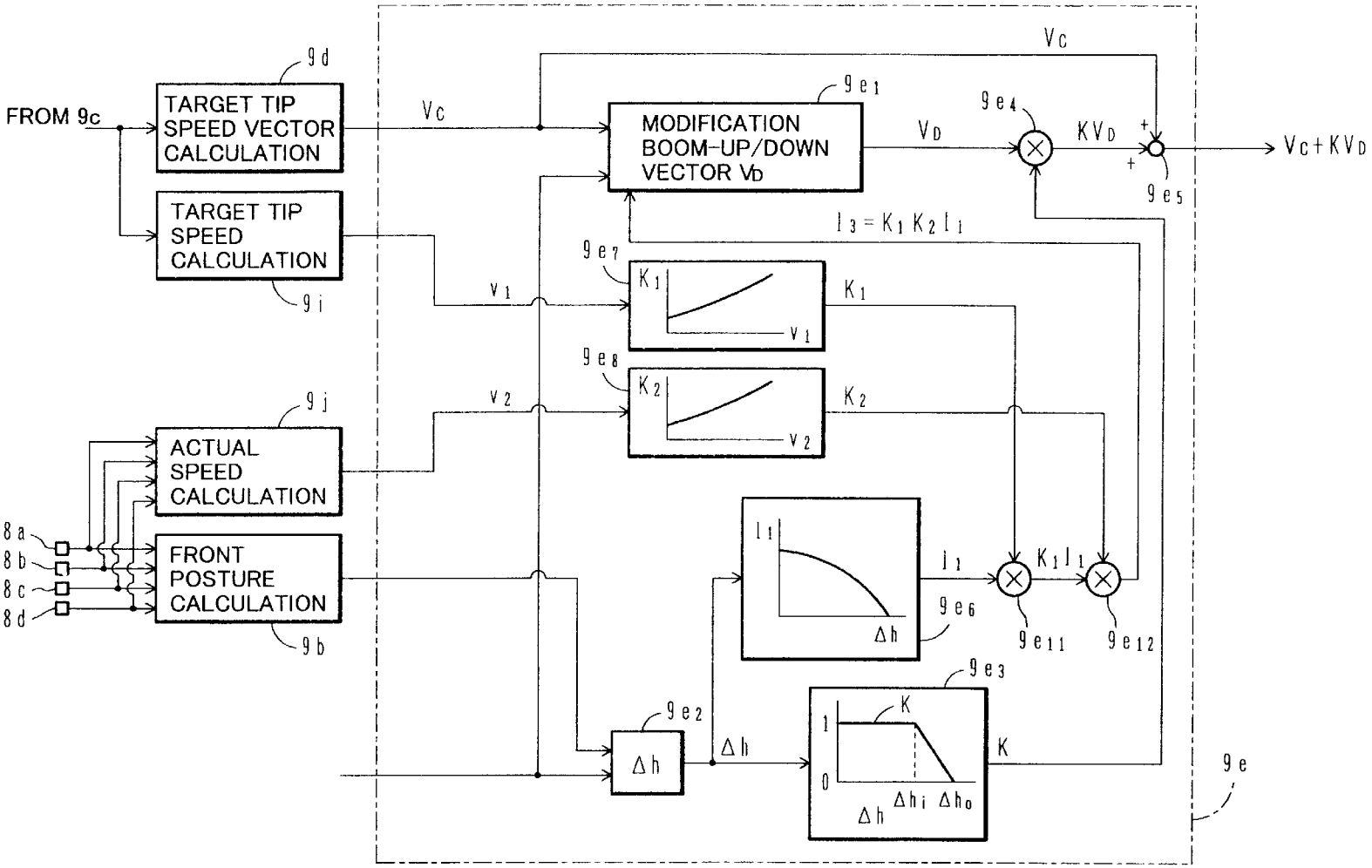
FIG. 15 is a block diagram showing a control process in still another variation of the vector direction modifying portion.

In addition to the advantage of the above variation <1>, this variation has an advantage that when the input amount to operate the boom, ice., the target speed v1 of the boom 1*a*, is relatively large, or when the actual speed v2 of the boom 1*a* at its tip is relatively fast, the distance l2 is set to a larger value, resulting in that a hunting or the like is prevented and stability in the control process is increased Furthermore, since the target speed v1 and the actual speed v2 are used in a combined manner, this variation can take advantage of a high response provided by the former and high accuracy provided by the latter <3> Variation using l1 variable depending on operation signal for boom/arm and moving speed of boom/arm A block diagram representing a control process in this variation of the vector direction modifying portion 9*e* is shown in FIG. 15. FIG. 15 is primarily different in configuration from FIG. 14 in that both the control gains K1, K2 are multiplied in respective multipliers 9*e*11, 9*e*12 by l1 from the l1 setting portion 9*e*6 to produce l3=K1×K2×l1 which is finally output to the modification boom-up/down vector calculating portion 9*e*1, and that the modification boom-up/down vector calculating portion 9*e*1 calculates the boom-up vector $V_D$ by using l3.

This variation can also provide similar advantages as in the above variation <2>.

Figure 16:
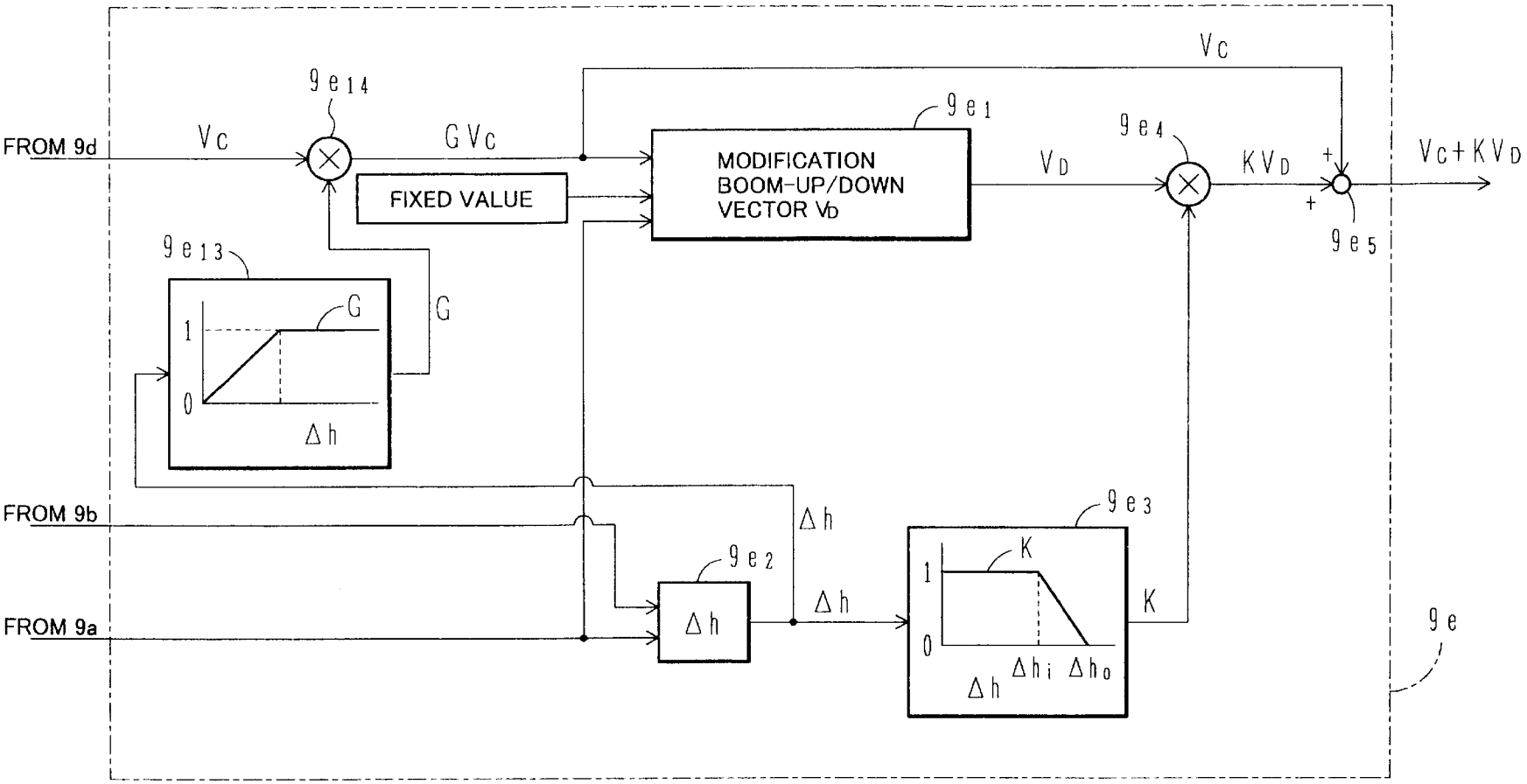
FIG. 16 is a block diagram showing a control process in still another variation of the vector direction modifying portion.

Further, in the above embodiment, the modification boom-up vector (or boom-down vector) $V_D$ for modifying the target speed vector $V_C$ is derived from the target speed vector $V_C$ itself as described in connection with FIG. 11, but the present invention is not limited thereto. Thus, the target speed vector $V_C$ may be reduced beforehand in accordance with the distance Δh between the tip of the bucket 1*c* and the target locus, and the modification boom-up vector (or boom-down vector) $V_D$ may be derived by using the reduced target speed vector. A block diagram representing a control process in this variation of the vector direction modifying portion 9*e* is shown in FIG. 16. FIG. 16 corresponds to FIG. 9 for the above embodiment.

Figure 17:
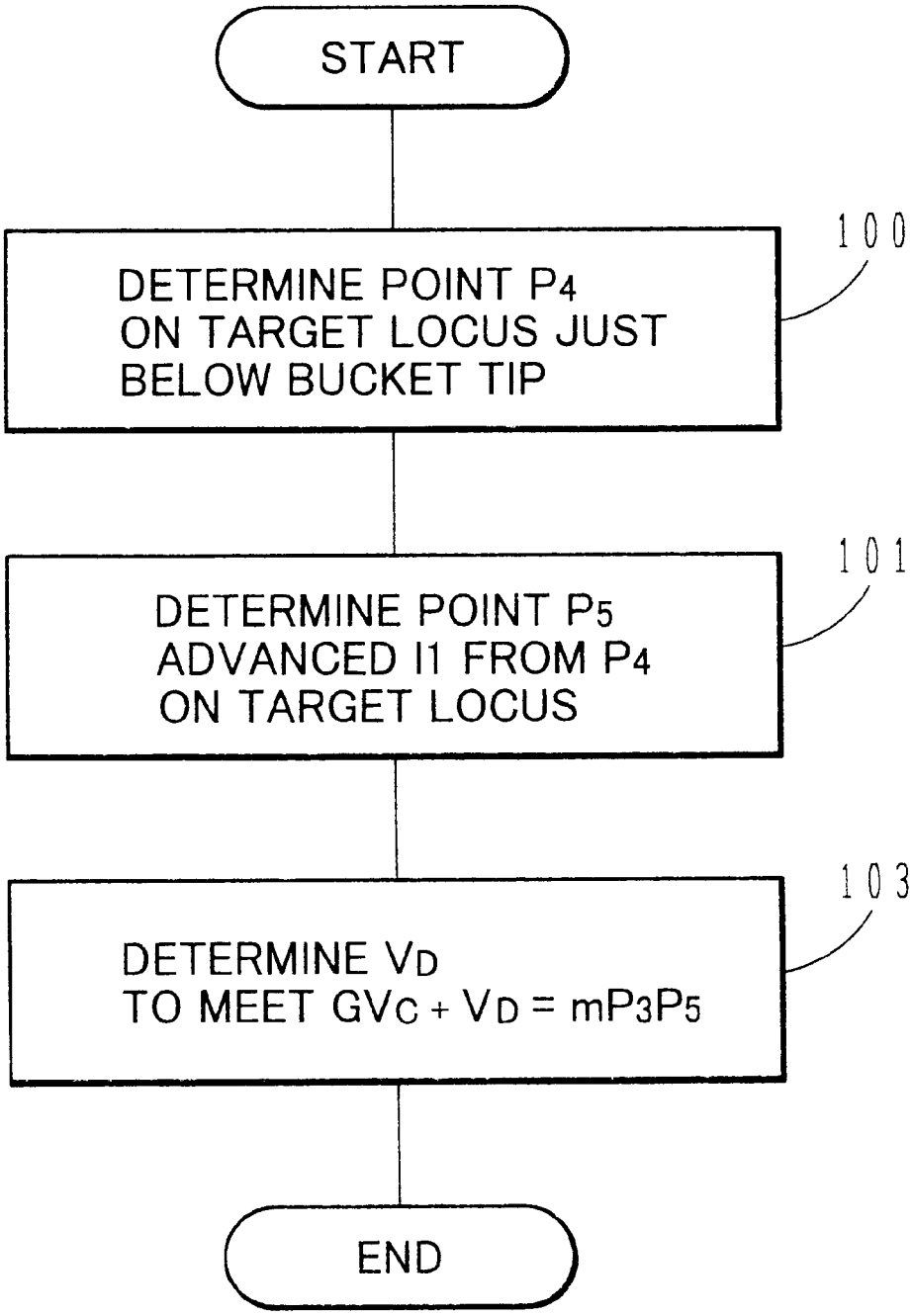
FIG. 17 is a flowchart showing another procedure of processing in the modification boom-up/down vector calculating portion illustrated in FIG. 16.
Figure 18:
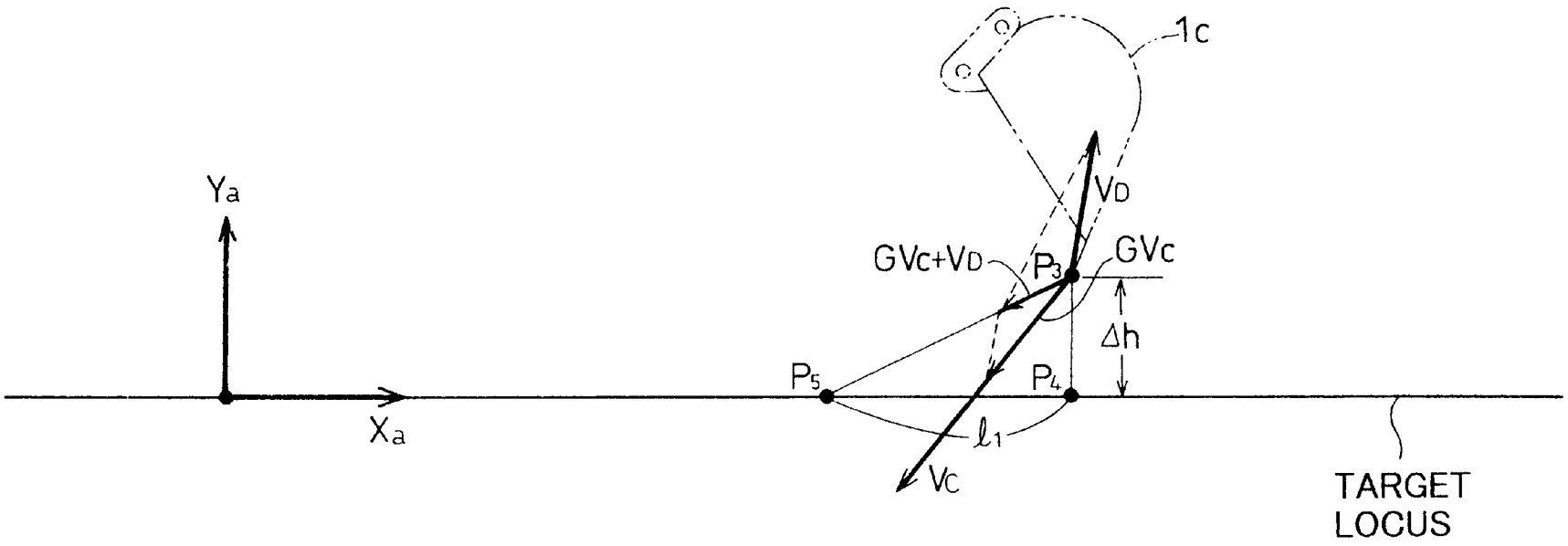
FIG. 18 is an explanatory view showing contents of the processing in the modification boom-up/down vector calculating portion illustrated in FIG. 16.
Figure 19:
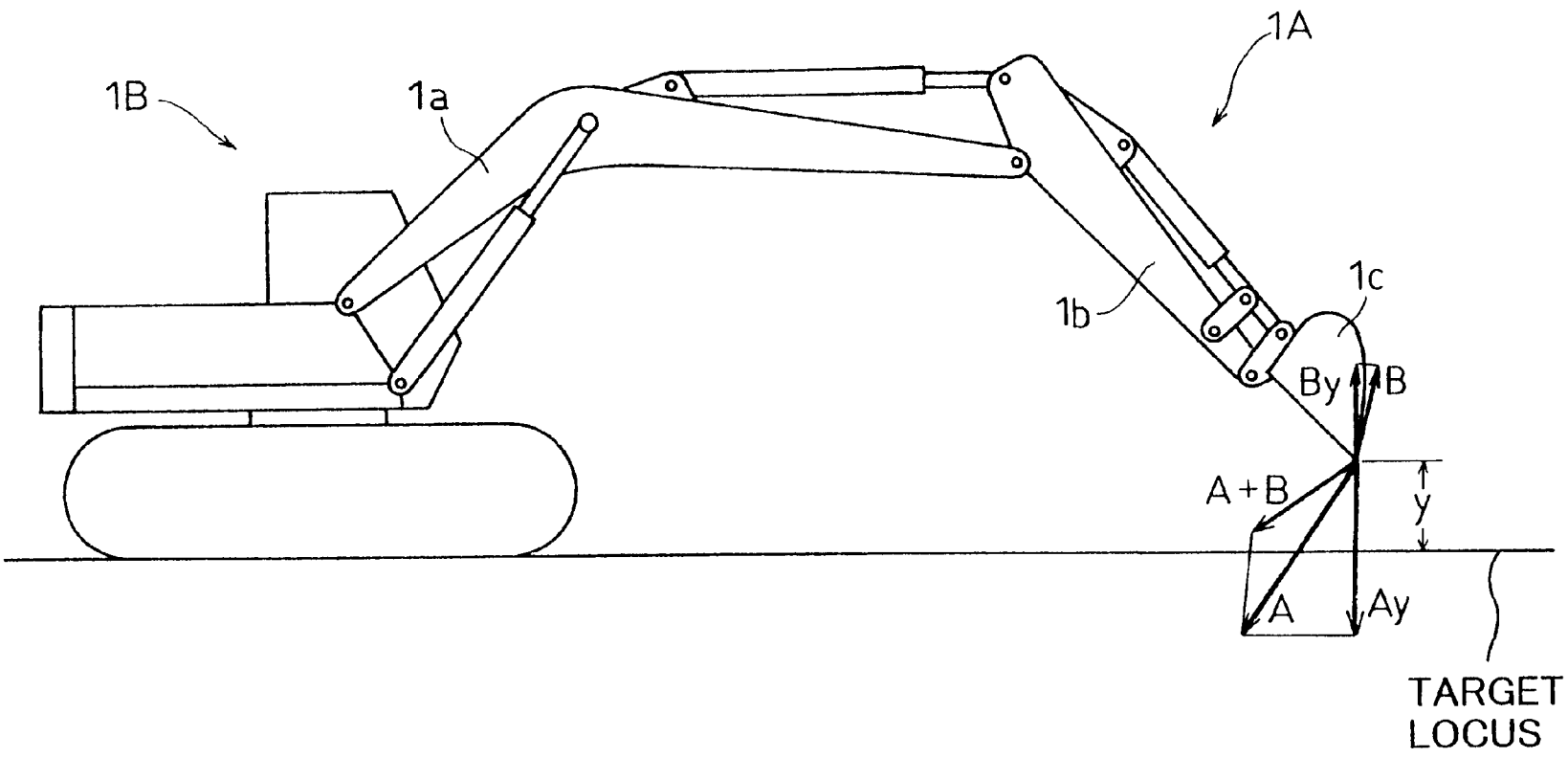
FIG.19 PRIOR ART
FIG. 19 is a view for explaining a conventional control method.

FIG. 16 differs in configuration from FIG. 9 in that the target speed vector $V_C$ calculated by the target tip speed vector calculating portion 9*d* is not directly input to the modification boom-up/down vector calculating portion 9*e*1 Specifically, a slowdown coefficient G is calculated by a slowdown coefficient calculating portion 9*e*13 in accordance with the minimum distance Δh calculated by the minimum distance detecting portion 9*e*2, and the slowdown coefficient G is multiplied in a multiplier 9*e*14 by $V_C$ to produce $GV_C$ which is input to the modification boom-up/down vector calculating portion 9*e*1. In accordance with $GV_C$, the modification boom-up/down vector calculating portion 9e1 calculates the modification boom-up/down vector V*D*. FIG. 17 is a flowchart showing a procedure of processing in this variation and FIG. 18 is an explanatory view showing contents of the processing FIGS. 17 and 18 correspond respectively to FIGS. 10 and 11 for the above embodiment.

In FIG. 17, a point P4 on the target locus away from the tip P3 of the bucket 1*c* by a minimum distance (see FIG. 18) is first determined in step 100 as with the procedure in FIG. 10. Then, a point P5 on the target locus advanced in the excavating direction by the distance l1 from the point P4 (see FIG. 18) is determined in step 101. After that, dissimilar from the procedure in FIG. 10, the magnitude of the boom-up vector (or boom-down vector) $V_D$ is determined in step 103 to meet the relationship of $GV_C+V_D=mP3P5$ (where m is a coefficient), i.e., so that the direction of $GV_C+V_D$ is the same as that of a vector P3P5.

With this variation, the tip of the bucket 1*c* is slowed down to a larger extent as it comes closer to the target locus. This results in a merit of lessening the possibility that the tip of the bucket 1*c* may deviate (e.g., downward) from the target locus due to a delay in control response or some other reason when the tip of the bucket 1*c* is settled to the target locus.

Furthermore, in the above embodiment, the point P4 (see FIG. 11) just below the tip P3 of the bucket 1*c* is determined by using a minimum distance as the first distance, but the present invention is not limited thereto. For example, P4 may be a point locating away from P3 by a distance of the minimum distance x certain value. Alternatively, a linear line may be drawn from P3 to intersect the target locus at an angle e (e.g., 60°) and a crossing point between the linear line and the target locus may be set as P4.

Also, in the above embodiment, the angle sensors 8*a*, 8*b*, 8*c* for detecting rotational angles of the members of the front device 1A are used as first detecting means for detecting status variables in relation to the position and posture of the front device. However, the present invention is not limited thereto, and displacement sensors for detecting actuator strokes, for example, may be used instead.

Furthermore, in the above embodiment, the boom-up vector (or boom-down vector) $V_D$ is used as modification vector to modify the target speed vector $V_C$. However, the present invention is not limited thereto, an arm crowding/dumping vector or both of the boom-up/down vector and the arm crowding/dumping vector, for example, may be used instead.

Additionally, while the above embodiment has been described as applying the present invention to a hydraulic excavator having control lever devices of hydraulic pilot type, the present invention is similarly applicable to a hydraulic excavator having electric lever devices. This case can also provide similar advantages.

According to the present invention, when the front device is operated to reach the target locus, the signal modifying means makes modification so that the front device is moved toward the second point. Therefore, by determining the second point depending on applications and/or situations of work, a path of movement of the front device from the current position to the target locus can be set to any desired path optionally, As a result, unlike the conventional system wherein which path the tip of the front device follows until reaching the target locus is not definite but depends on the operation of the operator, the tip of the front device can be settled to the target locus in a relatively quick, stable and highly accurate manner through a satisfactory path in match with a human feeling.

What is claimed is:

1. A locus control system equipped on a construction machine comprising a plurality of members to be driven including a plurality of front members which constitute a multi-articulated front device and are each rotatable vertically, a plurality of hydraulic actuators for driving respectively said plurality of members to be driven, a plurality of operating means for instructing movements of said plurality of members to be driven, and a plurality of hydraulic control valves driven in accordance with operation signals from said plurality of operating means and controlling flow rates of a hydraulic fluid supplied to said plurality of hydraulic actuators, said locus control system comprising locust setting means for setting a target locus along which said front device is to be moved, first detecting means for detecting status variables in relation to a position and posture of said front device, first calculating means for calculating the position and posture of said front device based on signals from the first detecting means, and signal modifying means for, based on the operation signals from those ones of said plurality of operating means associated with particular front members and values calculated by said first calculating means, modifying at least one of the operation signals from those operating means associated with said particular front members so that said front device is moved to reach said target locus wherein:

said signal modifying means modifies said operation signals so that said front device is moved toward a second point on said target locus advanced in the excavating direction by a second distance from a first point located on said target locus at a first distance from said front device and said signal modifying means sets said second distance as a fixed value.

2. A locus control system for a construction machine according to claim 1, wherein said signal modifying means uses, as said first distance, a minimum distance between said target locus and said front device.

3. A locust control system for a construction machine according to claim 1, wherein said signal modifying means includes second calculating means for calculating a target speed vector of said front device based on the operation signals from said operating means associated with said particular front members, third calculating means for receiving values calculated by said first and second calculating means, calculating a modification vector to modify said target speed vector based on the received values, and modifying said target speed vector based on said modification vector to point to said second point, and valve control means for driving the associated hydraulic control valves so that said front device is moved in accordance with said target speed vector modified by said third calculating means.

4. A locus control system for a construction machine according to claim 3, wherein said third calculating means includes modification vector altering means for altering said modification vector depending on said first distance.

5. A locus control system for a construction machine according to claim 1, wherein said signal modifying means modifies said operation signals only when said first distance is not greater than a predetermined distance.

6. A locus control system equipped on a construction machine comprising a plurality of members to be driven including a plurality of front members which constitute a multi-articulated front device and are each rotatable vertically, a plurality of hydraulic actuators for driving respectively said plurality of members to be driven, a plurality of operating means for instructing movements of said plurality of members to be driven, and a plurality of hydraulic control valves driven in accordance with operation signals from said plurality of operating means and controlling flow rates of a hydraulic fluid supplied to said plurality of hydraulic actuators, said locus control system comprising locus setting means for setting a target locus along which said front device is to be moved, first detecting means for detecting status variables in relation to a position and posture of said front device, first calculating means for calculating the position and posture of said front device based on signals from the first detecting means, and signal modifying means for, based on the operation signals from those ones of said plurality of operating means associated with said particular front members and values calculated by first calculating means, modifying at least one of the operation signals from those operation means associated with said particular front members so that said front device is moved to reach said target locus wherein:

said signal modifying means modifies said operation signals so that said front device is moved toward a second point on said target locus advanced in the excavating direction by a second distance from a first point locating on said target locus at a first distance from said front device and said signal modifying means sets said second distance to be variable depending on said first distance.

7. A locus control system for a construction machine according to claim 6, wherein said signal modifying means uses, as said first distance, a minimum distance between said target locus and said front device.

8. A locust control system for a construction machine according to claim 6, wherein said signal modifying means includes second calculating means for calculating a target speed vector of said front device based on the operation signals from said operating means associated with said particular front members, third calculating means for receiving values calculated by said first and second calculating means, calculating a modification vector to modify said target speed vector based on the received values, and modifying said target speed vector based on said modification vector to point to said second point, and valve control means for driving the associated hydraulic control valves so that said front device is moved in accordance with said target speed vector modified by said third calculating means.

9. A locus control system for a construction machine according to claim 6, wherein said signal modifying means modifies said operation signals only when said first distance is not greater than a predetermined distance.

10. A locus control system equipped on a construction machine comprising a plurality of members to be driven including a plurality of front members which constitute a multi-articulated front device and are each rotatable vertically, a plurality of hydraulic actuators for driving respectively said plurality of members to be driven, a plurality of operating means for instructing movements of said plurality of members to be driven, and a plurality of hydraulic control valves driven in accordance with operation signals from said plurality of operating means and controlling flow rates of a hydraulic fluid supplied to said plurality of hydraulic actuators, said locus control system comprising locus setting means for setting a target locus along which said front device is to be moved, first detecting means for detecting status variables in relation to a position and posture of said front device, first calculating means for calculating the position and posture of said front device based on signals from the first detecting means, and signal modifying means for, based on the operation signals from those ones of said plurality of operating means associated with particular front members and values calculated by said first calculating means, modifying at least one of the operation signals from those operating means associated with said particular front members so that said front device is moved to reach said target locus wherein:

said signal modifying means modifies said operation signals so that said front device is moved toward a second point on said target locus advanced in the excavating direction by a second distance from a first point located on said target locus at a first distance from said front device and said signal modifying means sets said second distance to be variable depending on a moving speed of said front device, at least those ones of said plurality of operating means associated with said particular front members are of hydraulic pilot type outputting pilot pressures as said operation signals, an operating system including said operating means of hydraulic pilot type drives the associated hydraulic control valves, said control system further comprising second detecting means for detecting input amounts by which said operating means of hydraulic pilot type are operated, second calculating means for calculating a target speed vector of said front device based on signals from said second detecting means, said valve control means including fourth calculating means for, based on said modified target speed vector, calculating target pilot pressures for driving the associated hydraulic control valves, and pilot control means for controlling said operating system so that said target pilot pressures are established, and said second detecting means comprises pressure sensors disposed in the pilot lines of said operating system.

11. A locus control system for a construction machine according to claim 10, wherein said modifying means sets said second distance to be variable depending on the operation signals from said operating means for said front device.

12. A locus control system for a construction machine according to claim 10, wherein said operating system includes a first pilot line for introducing a pilot pressure to the associated hydraulic control valve so that said front device is moved away from said target locus, said fourth calculating means includes means for calculating a target pilot pressure in said first pilot line based on said modified target speed vector, and said pilot control means includes means for outputting a first electric signal corresponding to said target pilot pressure, electro-hydraulic converting means for converting said first electric signal into a hydraulic pressure and outputting a control pressure corresponding to said target pilot pressure, and higher pressure selecting means for selecting a higher one of the pilot pressure in said first pilot line and the control pressure output from said electro-hydraulic converting means, and introducing the selected pressure to the associated hydraulic control valve.

13. A locus control system for a construction machine according to claim 12 wherein said particular front members include a boom and an arm of a hydraulic excavator, and said first pilot line includes a pilot line on the boom-up side.

14. A locus control system for a construction machine according to claim 10, wherein said operating system includes a second pilot line for introducing a pilot pressure to the associated hydraulic control valve so that said front device is moved toward said target locus, said fourth calculating means includes means for calculating a target pilot pressure in said second pilot line based on said modified target speed vector, and said pilot control means includes means for outputting a second electric signal corresponding to said target pilot pressure and pressure reducing means disposed in the second pilot line and operated in accordance with said second electric signal for reducing the pilot pressure in said second pilot line to said target pilot pressure.

15. A locus control system for a construction machine according to claim 14, wherein said particular front members include a boom and an arm of a hydraulic excavator, and there are a plurality of said second pilot lines on the boom-down side and the arm crowding side.

16. A locus control system for a construction machine according to claim 14, wherein said particular front members include a boom and an arm of a hydraulic excavator, and there are a plurality of said second pilot lines on the boom-down side, the arm crowding side, and the arm dumping side.

17. A locus control system for a construction machine according to claim 10, wherein said operating system includes a first pilot line for introducing a pilot pressure to the associated hydraulic control valve so that said front device is moved away from said target locus, and a second pilot line for introducing a pilot pressure to the associated hydraulic control valve so that said front device is moved toward said target locus, said fourth calculating means includes means for calculating target pilot pressures in said first and second pilot lines based on said modification target speed vector, and said pilot control means includes means for outputting first and second electric signals corresponding to said target pilot pressures, electro-hydraulic converting means for converting said first electric signal into a hydraulic pressure and outputting a control pressure corresponding to said target pilot pressure, higher pressure selecting means for selecting a higher one of the pilot pressure in said first pilot line and the control pressure output from said electro-hydraulic converting means and introducing the selected pressure to the associated hydraulic control valve, and pressure reducing means disposed in the second pilot line and operated in accordance with said second electric signal for reducing the pilot pressure in said second pilot line to said target pilot pressure.

18. A locus control system equipped on a construction machine comprising a plurality of members to be driven including a plurality of front members which constitute a multi-articulated front device and are each rotatable vertically, a plurality of hydraulic actuators for driving respectively said plurality of members to be driven, a plurality of operating means for instructing movements of said plurality of members to be driven, and a plurality of hydraulic control valves driven in accordance with operation signals from said plurality of operating means and controlling flow rates of a hydraulic fluid supplied to said plurality of hydraulic actuators, said locus control system comprising locus setting means for setting a target locus along which said front device is to be moved, fist detecting means for detecting status variables in relation to a position and posture of said front device, first calculating means for calculating the position and posture of said front device based on signals from the first detecting means, and signal modifying means for, based on the operation signals from those ones of said plurality of operating means associated with particular front members and values calculated by said first calculating means, modifying at least one of the operation signals from these operating means associated with said particular front members so that said front device is moved to reach said target locus wherein:

said signal modifying means modifies said operation signals so that said front device is moved toward a second point on said target locus advanced in the excavating direction by a second distance from a first point located on said target locus at a first distance from said front device and said signal modifying means modifies said operation signals only when said operation signals from those ones of said plurality of operating means associated with said particular front members are operation signals in the direction causing said front device to approach said target locus.

19. A locus control system for a construction machine according to claim 18, wherein said signal modifying means sets said second distance to be variable depending on the operation signals from said operating means for said front device.

* * * * *